US009201318B2

(12) United States Patent
Yu et al.

(10) Patent No.: US 9,201,318 B2
(45) Date of Patent: Dec. 1, 2015

(54) POLYMER FOR CHARGE GENERATION LAYER AND CHARGE TRANSPORT LAYER FORMULATION

(71) Applicant: XEROX CORPORATION, Norwalk, CT (US)

(72) Inventors: Robert C. U. Yu, Webster, NY (US); Stephen T. Avery, Rochester, NY (US); Jimmy E. Kelly, Rochester, NY (US); Mark Muscato, Webster, NY (US); J. Robinson Cowdery-Corvan, Webster, NY (US); Dennis J. Prosser, Walworth, NY (US)

(73) Assignee: XEROX CORPORATION, Norwalk, CT (US)

( * ) Notice: Subject to any disclaimer, the term of this patent is extended or adjusted under 35 U.S.C. 154(b) by 7 days.

(21) Appl. No.: 13/944,813

(22) Filed: Jul. 17, 2013

(65) Prior Publication Data

US 2015/0024310 A1 Jan. 22, 2015

(51) Int. Cl.
*G03G 5/05* (2006.01)

(52) U.S. Cl.
CPC ..... *G03G 5/0564* (2013.01); *G03G 5/0514* (2013.01); *G03G 5/0517* (2013.01); *G03G 5/0589* (2013.01); *G03G 5/0592* (2013.01)

(58) Field of Classification Search
CPC . G03G 5/0564; G03G 5/0592; G03G 5/0589; G03G 5/0514; G03G 5/0517
USPC ..... 430/58.05, 59.2, 70
See application file for complete search history.

(56) References Cited

U.S. PATENT DOCUMENTS

| | | | |
|---|---|---|---|
| 3,121,006 | A | 2/1964 | Middleton et al. |
| 4,265,990 | A | 5/1981 | Stolka et al. |
| 4,286,033 | A | 8/1981 | Neyhart et al. |
| 4,291,110 | A | 9/1981 | Lee |
| 4,338,387 | A | 7/1982 | Hewitt |
| 4,664,995 | A | 5/1987 | Horgan et al. |
| 5,069,993 | A | 12/1991 | Robinette |
| 5,153,094 | A | 10/1992 | Kazmaier |
| 5,166,339 | A | 11/1992 | Duff et al. |
| 5,189,155 | A | 2/1993 | Mayo et al. |
| 5,189,156 | A | 2/1993 | Mayo et al. |
| 5,215,839 | A | 6/1993 | Yu et al. |
| 5,382,486 | A | 1/1995 | Yu et al. |
| 5,660,961 | A | 8/1997 | Yu |
| 5,697,024 | A | 12/1997 | Mishra |
| 5,703,487 | A | 12/1997 | Mishra |
| 5,756,245 | A | 5/1998 | Esteghamatian et al. |

(Continued)

OTHER PUBLICATIONS

Robert C.U. Yu, et al., U.S. Appl. No. 12/782,671, filed May 18, 2010, now U.S. Patent No. 8,404,413, issued Mar. 26, 2013.

(Continued)

*Primary Examiner* — Thorl Chea
(74) *Attorney, Agent, or Firm* — Pillsbury Winthrop Shaw Pittman LLP

(57) ABSTRACT

The disclosure provides a flexible electrophotographic imaging member comprising a single novel polymer binder in the formulation of the imaging layers. In particular, the present embodiments provide multi-layered electrophotographic imaging members prepared by using the same polymer binder in the two contiguous imaging formation layers to improve mechanical and photoelectrical performance. The embodiments also include a process for making and using the imaging member.

15 Claims, 3 Drawing Sheets

(56) References Cited

U.S. PATENT DOCUMENTS

| | | | | |
|---|---|---|---|---|
| 5,958,638 | A | 9/1999 | Katayama et al. | |
| 6,008,653 | A | 12/1999 | Popovic et al. | |
| 6,119,536 | A | 9/2000 | Popovic et al. | |
| 6,150,824 | A | 11/2000 | Mishra et al. | |
| 6,660,441 | B2 | 12/2003 | Yu | |
| 7,166,399 | B2 | 1/2007 | Carmichael et al. | |
| 7,413,835 | B2 | 8/2008 | Lin et al. | |
| 7,455,941 | B2 | 11/2008 | Evans et al. | |
| 7,462,434 | B2 | 12/2008 | Yu et al. | |
| 2007/0054209 | A1* | 3/2007 | Azuma et al. | 430/73 |
| 2011/0229808 | A1* | 9/2011 | Yu et al. | 430/56 |
| 2011/0305981 | A1* | 12/2011 | Yu et al. | 430/56 |

OTHER PUBLICATIONS

Robert C.U. Yu, et al., U.S. Appl. No. 12/762,257, filed Apr. 16, 2010, now U.S. Patent No. 8,343,700, issued Jan. 1, 2013.

Hye-Yeon Cha, et al., U.S. Appl. No. 12/216,151, filed Jun. 30, 2008, now abandoned.

Robert C.U. Yu, et al., U.S. Appl. No. 10/982,719, filed Nov. 5, 2004, now U.S. Patent No. 7,592,111, issued Sep. 22, 2009.

Ferdinand Rodriguez, Principles of Polymer Systems, Taylor & Francis Publisher (1996), pp. 58-59.

Genhai G. Liang, Wayne, D. Cook, Henry J. Sautereau and Abbas Tcharkhtchi, Diallyl Orthophthalate as a Reactive Plasticer for Polycarbonate, European Polymer Journal 44 (2008), pp. 366-375.

* cited by examiner

POLYMER FOR CHARGE GENERATION LAYER AND CHARGE TRANSPORT LAYER FORMULATION

BACKGROUND

The presently disclosed embodiments are directed to an imaging member used in electrostatography. More particularly, the embodiments pertain to multi-layered electrophotographic imaging members prepared by using an identical polymer binder in the two contiguous imaging formation layers to eliminate the undesirable interfacial boundary effect and improves the imaging member photoelectrical performance. The embodiments also include a process for making and using the imaging member.

In electrophotographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Multi-layered electrophotographic imaging members which are commonly employed in electrophotographic (xerographic) processing systems are well known in the art. They are typically prepared to have two distinctive configurations, namely: (1) the flexible electrophotographic imaging member belts (belt photoreceptors) and (2) the rigid electrophotographic imaging members in drum configuration.

Although the scope of the present embodiments covers the preparation of both flexible and rigid types of electrophotographic imaging members, the discussion hereinafter will focus on the flexible electrophotographic imaging members for purposes of simplicity.

In conventional prior art electrophotographic flexible imaging members, there may be included a photoconductive layer including a single layer or composite layers. One type of composite photoconductive layer used in xerography is illustrated in U.S. Pat. No. 4,265,990 which describes an imaging member having at least two electrically operative layers. One layer comprises a photoconductive layer or charge generating layer which is capable of photogenerating holes and injecting the photogenerated holes into a contiguous charge transport layer. Generally, where the two electrically operative layers are supported on a conductive layer, the charge generating layer is sandwiched between a contiguous charge transport layer and the supporting conductive layer. Alternatively, the charge transport layer may be sandwiched between the supporting electrode and a charge generating layer.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

Typical negatively charged imaging member belts, such as flexible photoreceptor belt designs, are made of multiple layers comprising a flexible supporting substrate, a conductive ground plane, a charge blocking layer, an optional adhesive layer, a charge generating layer, a charge transport layer. The charge transport layer is usually the last layer, or the outermost layer, to be coated and is applied by solution coating then followed by drying the wet applied coating at elevated temperatures of about 120° C., and finally cooling it down to ambient room temperature of about 25° C. When a production web stock of several thousand feet of coated multilayered imaging member material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the charge transport layer in a typical imaging member has a coefficient of thermal contraction approximately 3.7 times greater than that of the flexible substrate support, the charge transport layer does therefore have a larger dimensional shrinkage than that of the substrate support as the imaging member web stock cools down to ambient room temperature. Since the typical flexible electrophotographic imaging member, if unrestrained, exhibits undesirable upward imaging member curling, an anticurl back coating, applied to the backside, is required to balance the curl. Thus, the application of anticurl back coating is necessary to provide the appropriate imaging member belt with desirable flatness.

Flexible electrophotographic imaging members having these electrically operative layers, as disclosed above, provide electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

However, when a negatively charged imaging member (e.g., in belt configuration) is in dynamic cyclic motion under a normal machine operation condition in the field, the anticurl back coating of conventional imaging members (as the outermost exposed backing layer) is subject to high surface contact friction when it slides and flexes over the machine subsystems of the belt support module, such as rollers, stationary belt guiding components, and backer bars. The mechanical/frictional sliding interactions of ACBC against the belt support module components have been found to create numbers of issues; such as: (1) exacerbate ACBC wear/abrasion, causing loss of anti-curling control capability and resulting in imaging member belt curling-up problem because the thinning of the ACBC reduces its curl control effectiveness to result in premature curling up of the imaging member that impacts normal imaging belt machine functioning condition, such as non-uniform charging for proper latent image formation; (2) create debris/dirt of ACBC wear-off that scatters and deposits on critical machine components such as lenses; (3) wear/abrasion/scratch damage in the ACBC does also produce unbalanced forces between the charge transport layer and the ACBC to cause micro belt ripples formation during electrophotographic imaging process; (4) cause the development of tribo-electrical charge built-up in the ACBC that increases belt drive torque and, in some instances, it has been found to result in belt stalling; (5) in other cases, the tribo-electrical charge build up can be so high as to cause sparking; and lastly (6) under extensively cycled condition in precision electrostatographic imaging machines, an audible squeaky sound generation due to high contact friction interaction between the ACBC and the backer bars has also been a problem. Therefore, premature ACBC failure shortens the imaging member belt functional life and requires frequent costly belt replacement in the field. Moreover, inclusion of an ACBC to provide flatness also incurs additional material and labor cost.

In the recent development of curl free imaging members, a charge transport layer composition for making a flexible imaging member having substantial flatness without the need of an anticurl back coating and free of the fore-mentioned deficiencies) has been demonstrated through the external charge transport layer plasticization process. This process is accomplished by incorporation of a selected high boiler liquid plasticizer into the charge transport layer composition to reduce the internal stress/strain in the layer for effective effect curl control. The resulting imaging member is flat without an anticurl back coating and provides reduced production cost and extended service life without the problems suffered by the conventional imaging members.

The high boiler liquid plasticizer selected for the charge transport layer must meet the following: (i) the plasticizer is compatible during physical mixing with both the charge transport compound and the polymer binder to ensure the photo-electrical function integrity of the resulting imaging member and (ii) the plasticizer has a boiling point exceeding 250° C., so it is permanently present in the layer without (or negligible) loss due to evaporation during the functional life of the imaging member.

The term charge transport layer external plasticization process is defined as adding a plasticizer into the material matrix of the layer via a physical mixing without being chemically bound to either the charge transport compound or polymer binder, so that the plasticizer provides the effect for Tg reduction of the charge transport layer to suppress internal stress/strain build-up in the layer. Since the plasticizer, added is physical mixed with the charge transport layer components to effect Tg reduction, the external plasticization process, by definition, differs from that of internal plasticization process in which the added plasticizer is chemically bound to the polymer in the layer through a copolymerization reaction. See Ferdinand Rodrigues, Principles of Polymer Systems, Taylor & Francis Publisher (1996), pp. 58 to 59, and European Polymer Journal 44 (2008), pp. 366-375.

In the conventional prior art imaging member designs, the charge transport layer and the charge generation layer are respectively coated by using different polymer binders. However, the use of a different polymer binder to form the charge transport layer and charge generation layer creates a region of material discontinuity at the interface between these two contiguous layers. The existence of this discontinuity has two undesirable effects: first, it has inadequate adhesion bounding in this region so that, under normal dynamic imaging member belt cycling function in the machine, occasional premature delamination/separation failure has been found to cut short imaging member belt service life; second, the material discontinuity in this region also impedes charge transporting efficiency to adversely impact photoelectrical function. This is known as the interfacial boundary effect. Thus, it is desired to provide an imaging member that eliminates the region of discontinuity between the charge generation and charge transport layers.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

Yu, U.S. Pat. No. 6,660,441, issued on Dec. 9, 2003, discloses an electrophotographic imaging member having a substrate support material which eliminates the need of an anticurl backing layer, a substrate support layer and a charge transport layer having a thermal contraction coefficient difference in the range of from about $-2\times10^{-5}$/° C. to about $+2\times10^{-5}$/° C., a substrate support material having a glass transition temperature (Tg) of at least 100° C., wherein the substrate support material is not susceptible to the attack from the charge transport layer coating solution solvent and wherein the substrate support material is represented by two specifically selected polyimides.

In U.S. Pat. No. 7,413,835 issued on Aug. 19, 2008, it discloses an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

In U.S. application Ser. No. 10/982,719, filed on Nov. 5, 20024 entitled "Imaging Member," by Yu et al., discloses an imaging member formulated with a liquid carbonate. The imaging electrostatographic member exhibits improved service life.

SUMMARY

According to the present embodiments illustrated herein, there is provided a flexible imaging member comprising: a flexible substrate; a charge generation layer disposed on the substrate; and at least one charge transport layer disposed on the charge generating layer, wherein the charge generation layer and the charge transport layer comprise a polycarbonate binder, the polycarbonate binder being an A-B di-block copolymer having the following formula:

$$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$. For the charge transport layer, there is further included m-TBD which is dispersed in the polycarbonate binder.

In particular, the present embodiments provide a flexible imaging member comprising: a flexible substrate; a charge generation layer disposed on the substrate; and at least one charge transport layer disposed on the charge generating layer, wherein the charge generation layer and the charge transport layer comprise a polycarbonate binder, the polycarbonate binder being an A-B di-block copolymer having a formula selected from the group consisting of Formula A

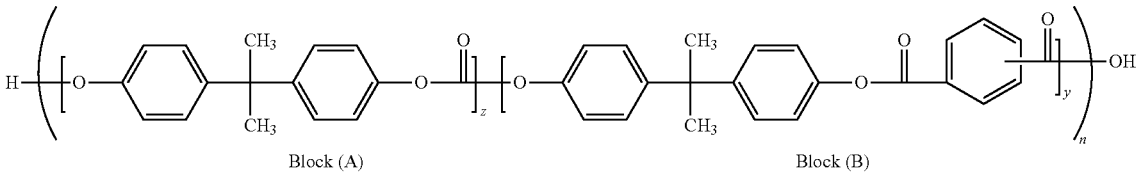

Formula B

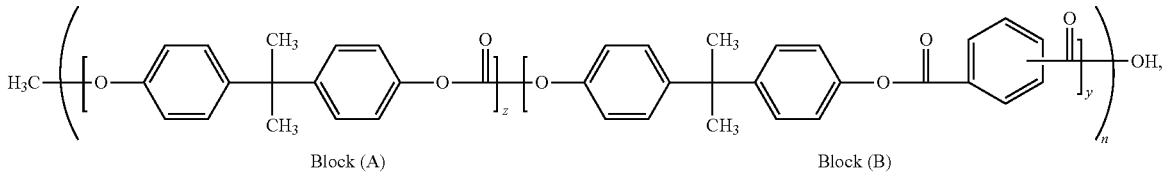

and mixtures thereof, and comprises about 90% mole bisphenol A polycarbonate segment block (A) and about 10% mole phthalic acid containing segment block (B) in linear linkage of the copolymer chain backbone, wherein z represents the number of bisphenol A repeating units of block (A) and is from about 9 to about 18, y is number of repeating phthalic acid in block (B) and is from about 1 to about 2, and n is the degree of polymerization and is from about 20 to about 80.

In further embodiments, there is provided an image forming apparatus for forming images comprising: a) a flexible imaging member having a charge retentive-surface for receiving an electrostatic latent image thereon, wherein the flexible imaging member comprises a flexible substrate; a charge generation layer disposed on the substrate; and at least one charge transport layer disposed on the charge generating layer, wherein the charge generation layer and the charge transport layer comprise a polycarbonate binder, the polycarbonate binder being an A-B di-block copolymer having the following formula:

$$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

To promote better understanding, reference may be made to the accompanying figures.

The following is a brief description of the drawings, which are presented for the purposes of illustrating the exemplary embodiments disclosed herein and not for the purposes of limiting the same.

DETAILED DESCRIPTION

Figure 1:
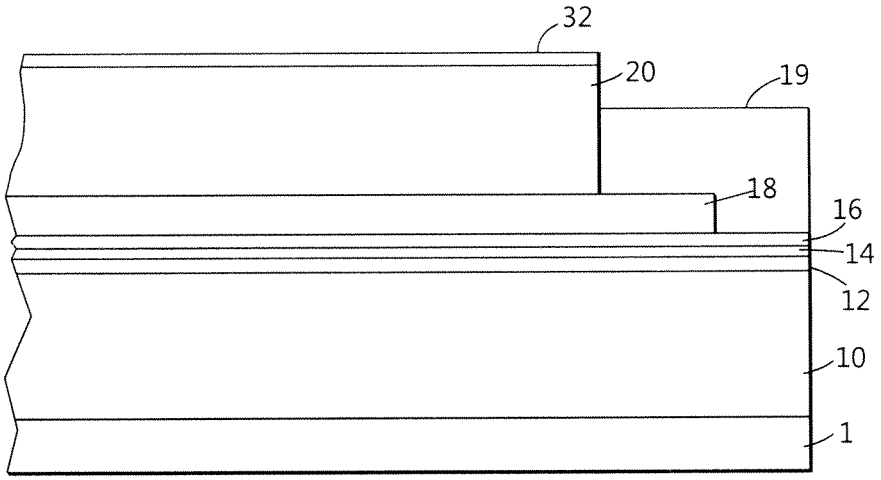
FIG. 1 is a schematic cross-sectional view of a conventional prior art flexible imaging member belt having contiguous charge transport layer and charge generation layer formulated using different polymer binders, and an anticurl back coating to render imaging member flatness.

In the following description, reference is made to the accompanying drawings, which form a part hereof and which illustrate the exemplary embodiments of the present disclosure herein and not for the purpose of limiting the same. It is also understood that other embodiments may be utilized and structural and operational changes may be made without departure from the scope of the present disclosure.

Conventional flexible negatively charged electrophotographic imaging member belts, comprising a single or composite photoconductive layers, such as for example, the charge generation layer (CGL) and CTL, through subsequent coating application of CGL over a flexible substrate support and CTL onto the CGL, exhibit undesirable upward imaging member curling. To offset and control the curl, an anticurl back coating (ACBC) is required to be coated onto the back side (opposite to the photoconductive layer(s) side) of the substrate support to impart the imaging member with the desired flatness.

The present embodiments provide improved negatively charged flexible electrophotographic imaging members which provide enhanced copy print out quality and extended service life. The improvements are achieved by formulating both the CTL and CGL to comprise the same polymer binder. As discussed above, there is a region of discontinuity between the CTL and CGL in conventional imaging members. To eliminate this region and to resolve the associated shortcomings, a novel polymer is selected for both charge transport layer and charge generation layer binders according to the present embodiments. In these embodiments, the contiguous charge transport layer and charge generation layer are both reformulated to utilize the same polymer binder comprising a high molecular weight film forming A-B diblock copolymer. The high molecular weight film forming A-B diblock copolymer used to provide material continuity between the two contiguous layers has a molecular formula of:

$$R_1\text{-}(\text{[Block A]}_x\text{-[Block B]}_y)_n\text{OH} \qquad \text{Formula I}$$

wherein Block A is a polycarbonate repeating unit, Block B is an organic acid containing repeating unit, z is from about 9 to about 45, y is from about 1 to about 5, n is between about 20 and about 80, and $R_1$ is H or $CH_3$.

In one embodiment, the conventional flexible imaging member is modified to use the A-B diblock copolymer binder in both the charge transport layer and charge generation layer. In another embodiment, the conventional flexible imaging member is modified so that the charge transport layer and the charge generation layer both comprise the A-B diblock copolymer and also a plasticizer in the charge transport layer to effect imaging member curl control so that the need for an anticurl back coating is eliminated.

The present embodiments thus provide flexible imaging members having two material configurations: (1) with one comprising an ACBC and (2) the other containing a plasticized CTL over a plasticized CGL to effect curl control for imaging member belt flatness. The prepared flexible negatively charged multiple layered electrophotographic imaging member belts as described may also optionally include a top outermost protective overcoat layer over the CTL.

The exemplary embodiments of this disclosure are further described below with reference to the accompanying figures. The specific terms are used in the following description for clarity, selected for illustration in the drawings and not to define or limit the scope of the disclosure. The structures in the figures are not drawn according to their relative proportions and the drawings should not be interpreted as limiting the disclosure in size, relative size, or location. In addition, though the discussion will address negatively charged systems, the imaging member belts of the present disclosure may also include material compositions designed to be used in positively charged systems. Also the term "photoreceptor" or "photoconductor" or photosensitive member is generally used interchangeably with the terms "imaging member." The term "electrostatographic" includes "electrophotographic" and "xerographic." The terms "charge transport molecule" are generally used interchangeably with the terms "hole transport molecule."

According to the first embodiment illustrated herein, there is provided a flexible imaging member belt comprising a flexible substrate support; a charge generating layer (CGL) disposed on the substrate; a charge transport layer (CTL) disposed on the charge generating layer (CGL); and an anticurl back coating (ACBC) disposed on the substrate support on a side opposite to the CGL/CTL. Both the CTL and CGL utilize the same polymer binder as identified in this disclosure.

According to the second embodiment illustrated herein, there is provided a structurally simplified flexible imaging member belt comprising a flexible substrate support; a plasticized CGL disposed on the substrate; and a plasticized CTL disposed on the plasticized CGL to render the imaging member flatness without an ACBC. Both the plasticized CTL and plasticized CGL utilize a common polymer binder as identified in this disclosure.

In embodiments, the disclosed polymer binder used in the CTL/CGL is a high molecular weight film forming A-B diblock copolymer that provides material continuity between the two contiguous layers. In embodiments, the polymer binder has a molecular formula of:

$$R_1\text{-}(\text{[Block A]}_x\text{-[Block B]}_y)_n\text{OH} \qquad \text{Formula I}$$

wherein Block A is a polycarbonate repeating unit, Block B is an organic acid containing repeating unit, z is from about 9 to about 45, y is from about 1 to about 5, n is between about 20 and about 80, and $R_1$ is H or $CH_3$.

As shown in FIG. 1, there is provided a negatively charged multi-layered flexible electrophotographic imaging member web having a conventional configuration. Specifically, it shows the typical structure of a conventional flexible multiple layered electrophotographic imaging member web comprising a substrate 10, an optional a conductive layer 12, an optional hole blocking layer 14 over the optional conductive layer 12, an optional adhesive layer 16 over the blocking layer 14, a CGL 18, a contiguous CTL 20, an optional ground strip layer 19 operatively connects the CGL 18 and the CTL 20 to the optional conductive layer 12, an optional over coat layer 32, and an ACBC 1 over the backside of the substrate 10 opposite to the electrically active layers for rendering appropriate imaging member web flatness. The ground strip layer 19 is included to provide electrical continuity and the optional overcoat layer 32 may be added on to provide abrasion/wear protection for the CTL 20. In the event that the CGL 18 is disposed on top of the CTL 20, the imaging member is then converted into a positively charged imaging member.

An exemplary flexible imaging member having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary imaging members, which are also hereby incorporated by reference.

The Substrate

The imaging member support substrate 10 is a flexible layer and may be opaque but preferably to be substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate (PET) from DuPont, or polyethylene naphthalate (PEN) available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of different configurations, such as for example, a plate, a cylinder, a drum, a scroll, an endless flexible belt, and the like. In the case of the substrate being in the form of a belt, as shown in the figures, the belt can be seamed or seamless. In certain embodiments, the photoreceptor is rigid. In certain embodiments, the photoreceptor is in a drum configuration.

The thickness of the substrate 10 of a flexible belt depends on numerous factors, including flexibility, mechanical performance, and economic considerations. The thickness of the flexible support substrate 10 of the present embodiments may be from 1.0 to about 7.0 mils; or from about 2.0 to about 5.0 mils.

The substrate support 10 is not soluble in the solvents used in each of the coating layer solutions. The substrate support 10 is optically transparent or semitransparent. The substrate support 10 remains physical/mechanical stable at temperature below about 170° C. Therefore, at or below 170° C. the substrate support 10, below which temperature, may have a thermal contraction coefficient ranging from about $1\times10^{-5}$/° C. to about $3\times10^{-5}$/° C. and a Young's Modulus of between about $5\times10^{5}$ psi ($3.5\times10^{4}$ Kg/cm$^2$) and about $7\times10^{5}$ psi ($4.9\times10^{4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness, over substantially wide ranges depending on the optical transparency and flexibility desired for the electrophotoconductive member. Accordingly, for a flexible photoresponsive imaging device, the thickness of the conductive layer is from about 20 Angstroms to about 750 Angstroms, or from about 50 Angstroms to about 200 Angstroms, for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer 16 may be provided in certain configurations, such as, for example, in flexible web configurations. In the embodiment illustrated in the figure, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik Inc., 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying CGL 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of at least about 0.01 micrometer, and no more than about 900 micrometers after drying. In certain embodiments, the dried thickness is from about 0.03 micrometer to about 1.00 micrometer, or from about 0.05 micrometer to about 0.50 micrometer.

The Ground Strip Layer

The ground strip layer 19 may comprise a film-forming polymer binder and electrically conductive particles. Typical film forming binder may include, for example, A-B diblock copolymer, polycarbonate, polystyrene, polyacrylate, polyarylate, and the like. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 19 may have a thickness of from about 7 micrometers to about 42 micrometers, from about 14 micrometers to about 27 micrometers, or from about 17 micrometers to about 22 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive, to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, the charge generating material is dispersed in an amount of from about 5 percent to about 95 percent by volume, from about 20 percent to about 80 percent by volume, or from about 40 percent to about 60 percent by volume of the resinous binder composition.

The CGL 18 containing the charge generating material and the resinous binder material generally ranges in thickness of from about 0.1 micrometer to about 5 micrometers, or from about 0.2 micrometer to about 3 micrometers. In certain embodiments, the charge generating materials in CGL 18 may include chlorogallium phthalocyanine, hydroxygallium phthalocyanines, or mixture thereof.

The CGL thickness is generally related to binder content. Higher binder content compositions generally employ thicker layers for charge generation layers.

The Conventional Charge Transport Layer

Although the CTL is discussed specifically in terms of a single layer 20, the details apply to embodiments having dual or multiple charge transport layers. The CTL 20 of conventional design is typically applied by solution coating over the CGL 18. In the coating process, the CTL along the adjacent ground strip layer is disposed on the CGL by co-coating application. The conventional CTL 20 may include a film forming transparent organic polymer or a non-polymeric material. Such transparent organic polymers and non-polymeric materials are capable of supporting the injection of photogenerated holes or electrons from the CGL 18 to allow the transport of these holes/electrons through the conventional CTL 20 to selectively discharge the surface charge on the imaging member surface. During the electrophotographic imaging process, the conventional CTL 20 supports holes transporting, and protects the CGL 18 from abrasion or chemical attack, thereby extends the service life of the imaging member. Interestingly, the conventional CTL 20 may be a substantially non-photoconductive material, yet it supports the injection of photogenerated holes from the CGL 18 below.

The conventional CTL 20 is normally transparent in a wavelength region in which the electrophotographic imaging member is to be used when exposure is affected there to ensure that most of the incident radiation is utilized by the underlying charge generation layer 18. The conventional CTL 20 should exhibit excellent optical transparency with negligible light absorption and no charge generation when exposed to a wavelength of light useful in xerography, e.g., 400 to 900 nanometers. In the case when the imaging member is prepared with the use of a transparent support substrate 10 and also a transparent conductive ground plane 12, image wise exposure or erase may alternatively (or optionally) be accomplished through the substrate 10 with all light passing through the back side of the support substrate 10. In this particular case, the materials of the conventional CTL 20 need not have to be able to transmit light in the wavelength region of use for electrophotographic imaging processes if the charge generating layer 18 is sandwiched between the support substrate 10 and the conventional CTL 20. In all events, the top conventional CTL 20 in conjunction with the charge generating layer 18 is an insulator to the extent that an electrostatic charge deposited/placed over the conventional CTL 20 is not conducted in the absence of radiant illumination. Importantly, the conventional CTL 20 should trap minimal or no charges as the charge pass through it during the image copying/printing process.

Typically, the conventional CTL 20 disclosed in all prior arts is a binary solid solution comprising a film forming polymer and charge transport compound or activating compound useful as an additive dissolved or molecularly dispersed in an electrically inactive polymeric material, such as a polycarbonate binder, to form a solid solution and thereby making this material electrically active. "Dissolved" refers, for example, to forming a solid solution in which polymeric material to a material capable of supporting the injection of photogenerated holes from the CGL 18 and capable of allowing the transport of these holes through the conventional CTL 20 in order to discharge the surface charge on the conventional CTL 20. The high mobility charge transport component may comprise small molecules of, an organic compound which cooperate to transport charge between molecules and ultimately to the surface of the conventional CTL 20.

A number of charge transport compounds can be included in the conventional CTL 20. Examples of charge transport components are aryl amines of the following formulas:

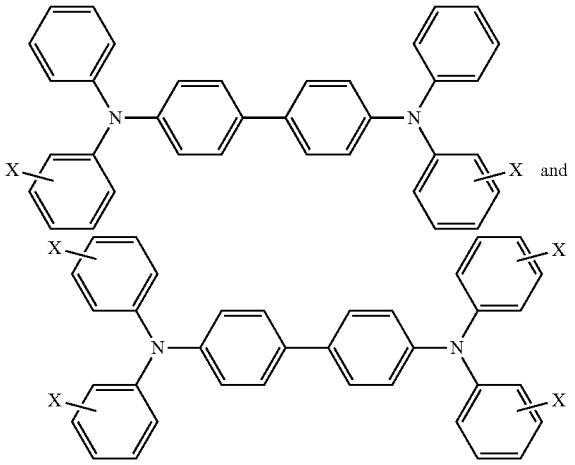

and wherein each X is independently alkyl, alkoxy, aryl, and derivatives thereof, or a halogen, or mixtures thereof. In certain embodiments, each X is independently Cl or methyl. Additional examples of charge transport components are aryl amines of the following formulas:

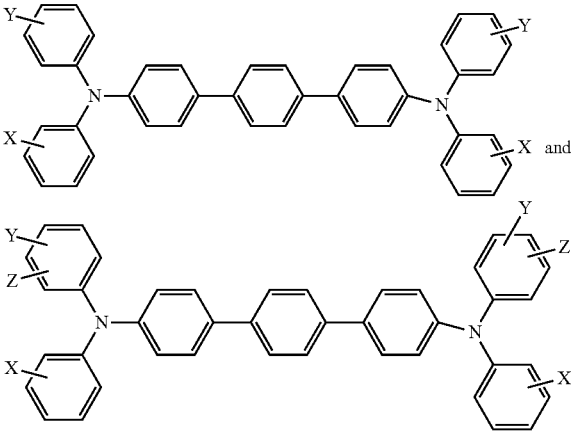

and wherein X, Y and Z are independently alkyl, alkoxy, aryl, halogen, or mixtures thereof, and wherein at least one of Y and Z are present.

Alkyl and alkoxy may be substituted or unsubstituted, containing from 1 to about 25 carbon atoms, and more specifically, from 1 to about 12 carbon atoms, such as methyl, ethyl, propyl, butyl, pentyl, and the corresponding alkoxides. Aryl may be substituted or unsubstituted, containing from 6 to about 36 carbon atoms, such as phenyl, and the like. Halogen includes chloride, bromide, iodide, and fluoride.

Exemplary charge transport components include aryl amines such as N,N'-diphenyl-N,N'-bis(methyl)phenyl)-1,1-biphenyl-4,4'-diamine, 1,1'-biphenyl-4,4'-diamine, N,N'-diphenyl-N,N'-bis(chlorophenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, In one embodiment, the charge transport component is N,N'-diphenyl-N,N'-bis(3-methyl phenyl)-1,1'-biphenyl-4,4'-diamine (TPD) and N,N,N',N'-tetra-p-tolyl-1,1'-biphenyl-4,4'-diamine (TM-TPD), and the like. Other known charge transport layer components may be selected in embodiments, reference for example, U.S. Pat. Nos. 4,921,773 and 4,464,450, the disclosures of which are totally incorporated herein by reference.

In one embodiment, the charge transport component is N,N'-diphenyl-N,N-bis(3-methyl phenyl)-1,1'-biphenyl-4,4'-diamine (TPD). In another embodiment, the charge transport component is N,N,N',N'-tetra-p-tolyl-1,1'-biphenyl-4,4'-diamine (TM-TPD).

Examples of the binder materials selected for the CTL 20 include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In one embodiment, the charge transport layer includes polycarbonates.

Typically, the formulation of the conventional CTL 20 is a solid solution which includes a charge transport compound molecularly dispersed or dissolved in a film forming polycarbonate binder, such as poly(4,4'-isopropylidene diphenyl carbonate) (i.e., bisphenol A polycarbonate), or poly(4,4'-diphenyl-1,1'-cyclohexane carbonate) (i.e., bisphenol Z polycarbonate).

Bisphenol A polycarbonate used for the conventional CTL 20 formulation is available commercially: MAKROLON (from Farbensabricken Bayer A.G) or FPC 0170 (from Mitsubishi Chemicals). Bisphenol A polycarbonate, poly(4,4'-isopropylidene diphenyl carbonate), has a weight average molecular weight of from about 80,000 to about 250,000, and a molecular structure of Formula X below:

Formula X

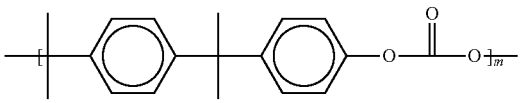

wherein m is the degree of polymerization, from about 310 to about 990. Bisphenol Z polycarbonate, poly(4,4'-diphenyl-1,1'-cyclohexane carbonate), has a weight average molecular weight of from about 80,000 to about 250,000, and a molecular structure of Formula Y below:

Formula Y

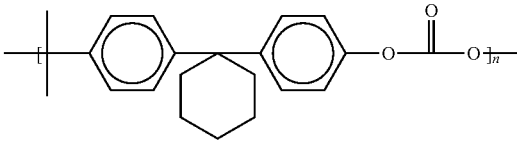

wherein n is the degree of polymerization, from about 270 to about 850.

The conventional CTL 20 is an insulator to the extent that the electrostatic charge placed on the conventional CTL 20 surface is not conducted in the absence of illumination at a rate sufficient to prevent formation and retention of an electrostatic latent image thereon. The conventional CTL 20 is substantially non-absorbing to visible light or radiation in the region of intended use. The conventional CTL 20 is yet electrically "active," as it allows the injection of photogenerated holes from the charge generation layer 18 to be transported through itself to selectively discharge a surface charge presence on the surface of the conventional CTL 20.

Any suitable and conventional technique may be utilized to form and thereafter apply the conventional CTL 20 coating solution to the supporting substrate layer. The conventional CTL 20 may be formed in a single coating step to give single conventional CTL 20 or in multiple coating steps to produce dual layered or multiple layered CTLs. Dip coating, ring coating, spray, gravure or any other coating methods may be used. For dual layered design, the CTL 20 includes a top CTL and a bottom CTL in contiguous contact with the CGL 18. The top CTL may contain less charge transport compound than the bottom CTL for impacting mechanically robust function. The top and bottom CTLs may have different thickness, or the same thickness. Drying of the applied wet coating layer(s) may be effected by any suitable conventional technique such as oven drying, infra red radiation drying, air drying and the like.

During the manufacturing process of a conventional negatively charged flexible imaging member, the conventional CTL 20 is coated over the CGL 18 by applying a CTL solution coating on top of the CGL 18, then subsequently drying the wet applied CTL coating at elevated temperatures of about 120° C., and finally cooling down the coated imaging member web to the ambient room temperature of about 25° C. Due to the thermal contraction mismatch between the conventional CTL 20 and the substrate support 10, the processed imaging member web (after finishing CTL drying/cooling process), if unrestrained, does exhibit spontaneous upward curling as a result of greater dimensional contraction of conventional CTL 20 than that of substrate support 10.

Without being bounded by theory, the development of this upward imaging member curling may be explained by the following mechanisms:

(1) while the imaging member web after application of wet CTL coating (typically comprising equal parts of a polycarbonate binder and a specific diamine charge transport compound dissolved in an organic solvent) over a 3½ mil polyethylene naphthalate substrate (or a polyethylene terephthalate) is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction;

(2) during the cool down period, the temperature falls and reaches the glass transition temperature (Tg) of the CTL at 85° C., the CTL instantaneously solidifies and adheres to the underneath CGL as it transforms from being a viscous liquid into a solid layer; and (3) as the CTL temperature subsequently drops from its Tg of 85° C. down to the 25° C. room ambient, the solid CTL in the imaging member web laterally contracts more than the flexible substrate support due to significantly higher thermal coefficient of dimensional contraction than that of the substrate support. Such differential in dimensional contraction between these two layers results in internal tension strain built-up in the CTL and compresses the substrate support layer, which thus pulls the imaging member web upwardly to exhibit curling. That means the processed imaging member web (with the finished CTL coating obtained through drying/cooling process) will spontaneously curl upwardly into a roll.

The internal tension pulling strain built-up in the dried CTL 20 can be calculated according to the expression of equation (1) below:

$$\epsilon=(\alpha_{CTL}-\alpha_{sub})(Tg_{CTL}-25^\circ\text{ C.}) \quad (1)$$

wherein $\epsilon$ is the internal strain build-in in the charge transport layer, $\alpha_{CTL}$ and $\alpha_{sub}$ are coefficient of thermal contraction of conventional CTL 20 and substrate 10 respectively, and $Tg_{CTL}$ is the glass transition temperature of the conventional CTL 20.

The thickness of the conventional CTL 20 (being a single, dual, or multiple layered CTLs), after drying and cooling steps, is between about 15 and about 40 micrometers, but preferably to be between about 20 and about 35 micrometers for achieving optimum photoelectrical and mechanical results. The conventional CTL 20 typically has a Young's Modulus of about $3.5\times10^5$ psi and a thermal contraction coefficient of about $6.6\times10^{-5}$/° C. compared to the Young's Modulus of about $5.4\times10^5$ psi and the thermal contraction coefficient of about $1.8\times10^{-5}$/° C. for the conventional polyethylene terephthalate substrate support.

If the completed imaging member web having a 29-micrometer thickness of dried conventional CTL 20 (comprising equal parts of a polycarbonate binder and a specific diamine charge transport compound), is coated over a 3½ mil polyethylene terephthalate (or a polyethylene naphthalate) substrate support 10 and is unrestrained, it will spontaneously curl-up into a 1½-inch roll. To balance the curl and render the desired imaging member web flatness, a standard ACBC 1 having a conventional composition is generally included in the conventional imaging member web.

The Conventional Anti-Curl Back Coating Layer

As the imaging member web exhibits spontaneous upward curling after the completion of the conventional CTL 20 coating/drying and cooling processes, a conventional ACBC 1 is applied to the back side of the substrate 10 to counteract the curl and provide flatness. Typically, a conventional ACBC for effective curl control is formulated to comprised of a film forming polymer and a small amount of an adhesion promoter. Although the film forming polymer employed in the conventional ACBC 1 formulation may be different from the polymer binder used in the conventional CTL 20, but it is preferred to be the exact same one as that in the conventional CTL. It is also important to mention that that the polymer(s) used in the conventional ACBC formulation and that in the conventional CTL has about equivalent thermal contraction coefficient to effect best imaging member curl control outcome. For imaging member having a typical 29 micrometers CTL 20 thickness, a conventional 17 micrometers polycarbonate ACBC 1 is need to balance/control the curl and provide flatness.

It is important to mention that the polymer binder used for the formulation of the conventional CTL 20 in the typical prior art flexible imaging member design is dis-similar or different from the polymer binder employed in the formulation of CGL 18. This thus creates a boundary region or interface of material discontinuity between these two layers. The presence of this region of discontinuity between these two contiguous layers is very undesirable because: (1) it causes the development of micro delamination/separation sites under a normal imaging member belt machine cycling function condition in the field, leading to black spots defects in copy print out; and (2) it impedes charge transporting efficiency during electrophotographic imaging process to negatively impact copy print out quality.

The Optional Overcoat Layer

Referring to FIG. 1, the imaging member may also include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 5 micrometers, or in a specific embodiment, about 3 micrometers. These over-coating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including nano particles of aluminum oxide, non-metal oxides including silica or low surface energy polytetrafluoroethylene (PTFE), and combinations thereof. Suitable resins for use include those described in the preceding for photogenerating layers and/or charge transport layers, for example, the A-B diblock copolymer, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The Disclosure Imaging Member I

Figure 2:
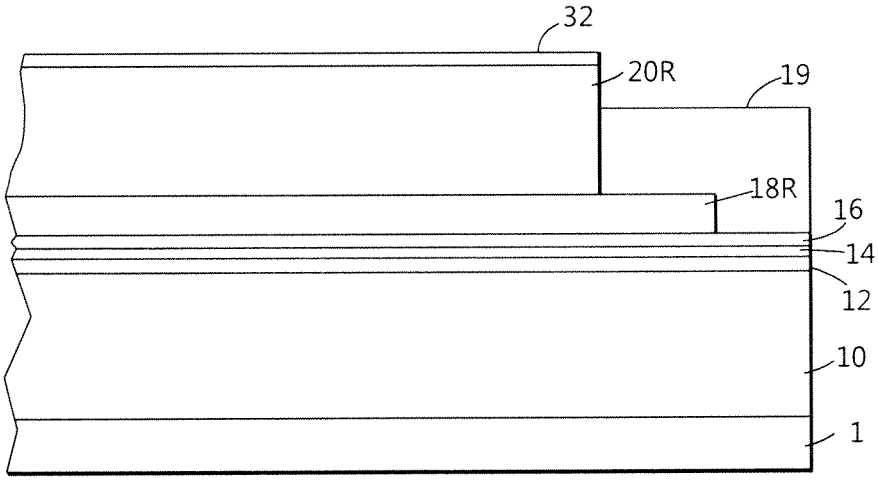
FIG. 2 is a schematic cross-sectional view of a first exemplary flexible imaging member belt having both the charge transport layer and the charge generation layer formulated to comprise the same A-B diblock copolymer binder to provide binder material continuity in the two contiguous layers according to the present embodiments.

The flexible imaging member web of present disclosure, shown in FIG. 2, is a modification of prior art imaging member web described in FIG. 1. The disclosed imaging member is prepared to have identical layers, material compositions, and followed the same procedures detailed above, but with the exception that the respective polymer binder used in both of these contiguous CTL 20 and CGL 18 are each then replaced with the same AB-diblock copolymer binder according to the present embodiments for providing the elimination of the region of discontinuity and related issues. The A-B diblock copolymer selected to meet the intended purpose is a high molecular weight film forming copolymer having a generic formula represented by Formula I below:

$$R_1\text{-}(\text{[Block A]}_x\text{-[Block B]}_y)_n\text{OH} \qquad \text{Formula I}$$

wherein block A is a polycarbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 80,000 and about 250,000 or between about 100,000 and about 200,000, or between about 110,000 and about 150,000.

The film forming A-B diblock copolymer used as binder for CTL 20 and CGL 18 reformulations is a polycarbonate derived from different types of polycarbonates and by the inclusion of small fraction from one of different dicarboxylic acids into the polymer backbone, resulting in a copolymer that contains from about 98 mole percent to about 80 mole percent, or from about 95 mole percent to about 85 mole percent of a carbonate segmental block A linearly linking to from about 2 mole percent to about 20 mole percent or from about 5 mole percent to about 15 mole percent of a segmental block B containing of a dicarboxylic acid terminal in the A-B diblock copolymer chain. In specific embodiments, the resulting copolymer contains about 90 mole percent of a segment block A linearly linking to about 10 mole percent of a segmental block B of an acid terminal in the A-B diblock copolymer chain.

The polycarbonate segment block A of the A-B diblock copolymer has the following structure:

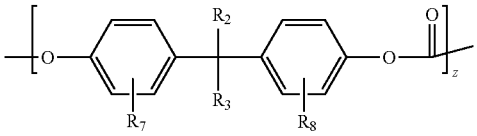

wherein each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_7$, $R_3$ is independently H or lower $C_1$-$C_3$ alkyl; and z is between about 9 and about 18, between about 27 and about 36, or between about 45 and about 54. In certain embodiments, each of $R_2$, $R_3$ is methyl, or $R_2$ and $R_3$ taken together with the C atom to which they are attached form a cyclohexane, where any ring atom of the cyclohexane may be optionally substituted with one or more methyl. In certain embodiments, each of $R_7$, $R_8$ is H or each of $R_7$, $R_8$ is methyl.

The segment block B of the A-B diblock copolymer has the following structure:

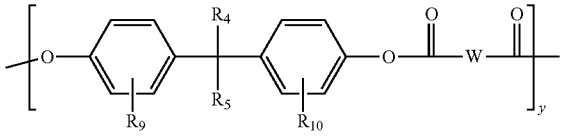

wherein each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_9$, $R_{10}$ is independently H or a lower $C_1$-$C_3$ alkyl; and y is between about 1 and about 2. In certain embodiments, each of $R_4$, $R_5$ is methyl, or $R_4$ and $R_5$ taken together with the C atom to which, they are attached form a cyclohexane, where any ring atom of the cyclohexane may be optionally substituted with one or more methyl. In certain embodiments, each of $R_9$, $R_{10}$ is H or each of $R_9$, $R_{10}$ is methyl.

In specific embodiments, the film forming A-B diblock copolymer used for ACBC formulation is a polycarbonate derived from the bisphenol A polycarbonate structure by the inclusion of small fraction of dicarboxylic acid into the polymer backbone, resulting in a copolymer that contains about 90 mole percent of a bisphenol A segment block A linearly linking to about 10 mole percent of a segmental block B of dicarboxylic acid terminal in the A-B diblock copolymer chain.

Exemplary polycarbonates (Block A) include the following carbonates:

Formula A-1

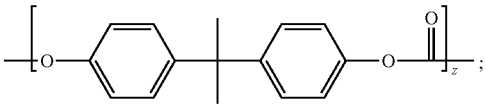

(bisphenol A carbonate)

Formula A-2

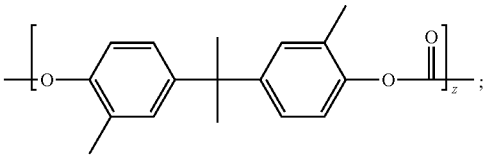

Formula A-3

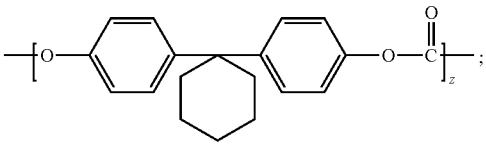

Formula A-4

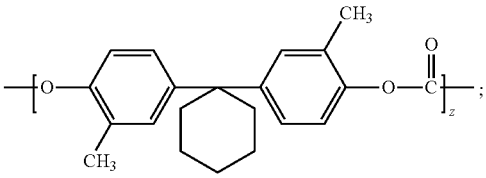

-continued

Formula A-5

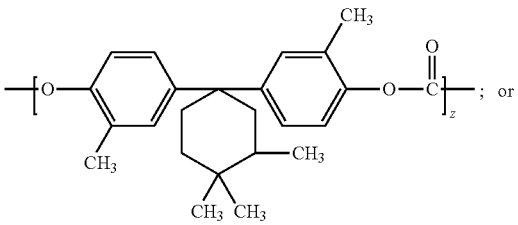

Formula A-6

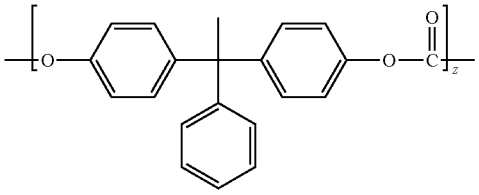

wherein z is an integer representing the numbers of repeating segmental carbonate unit, and is from about 9 to about 18, from about 27 to about 36, or from about 45 to about 54.

The acid terminal units (Block B) have the following structures:

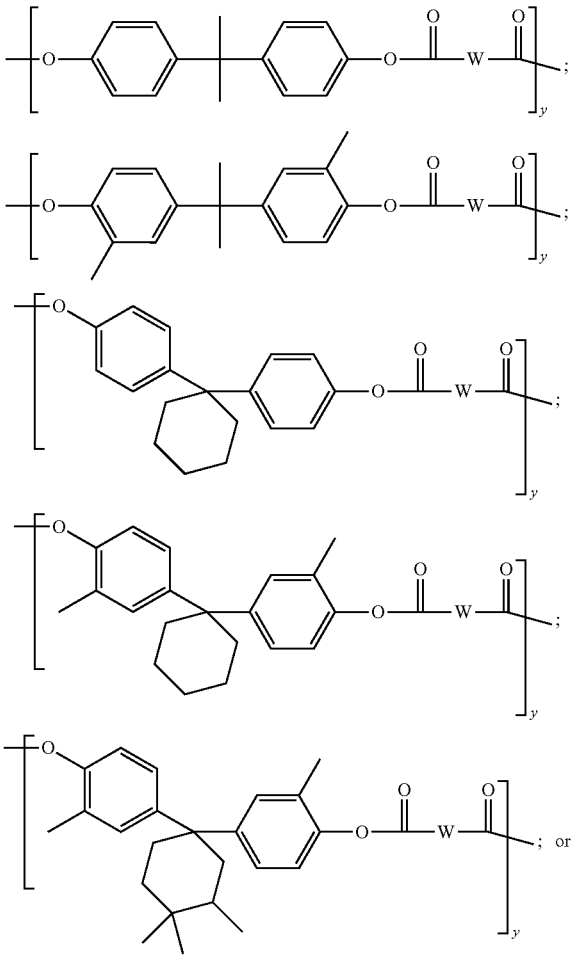

-continued

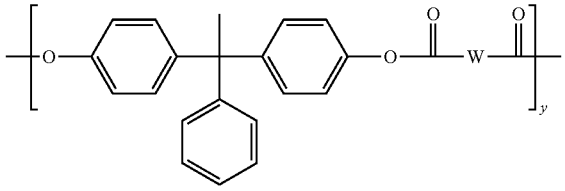

wherein W is an aromatic moiety or an aliphatic moiety, and y is from about 1 to about 6. In certain embodiments, W is an aryl having from 6 to 36 carbon atoms, or from 6 to 24. In certain of such embodiments, W is a phenyl. In certain embodiments, W is an alkylene having from 2 carbon atoms to 10 carbon atoms, from about 3 to about 8 carbons, or from 4 to 6 carbons.

In certain of such embodiments, the dicarboxylic acid terminal units have the following structures:

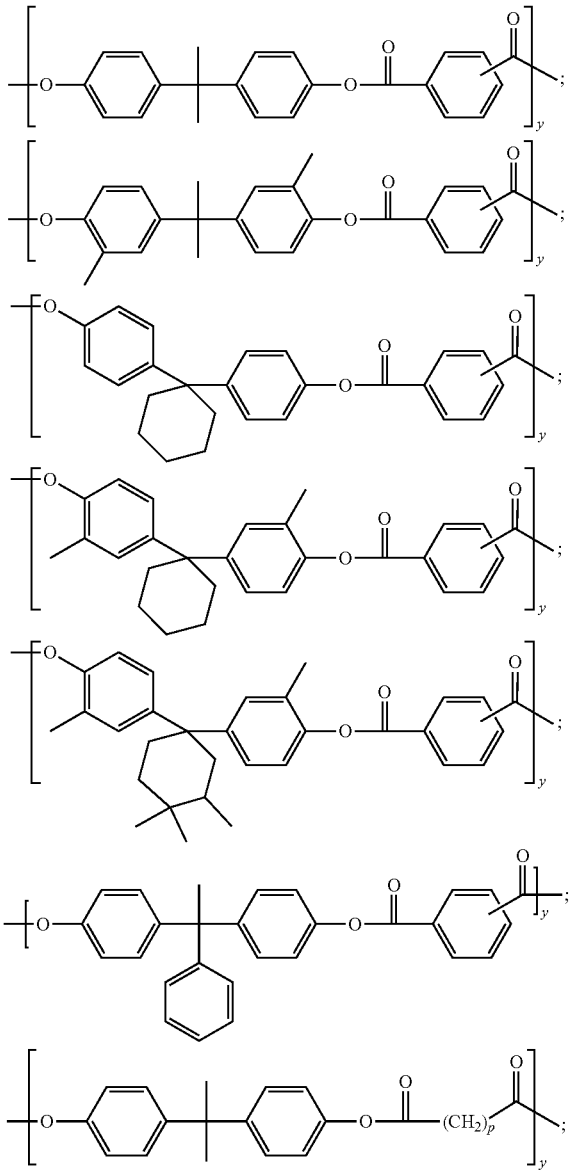

-continued
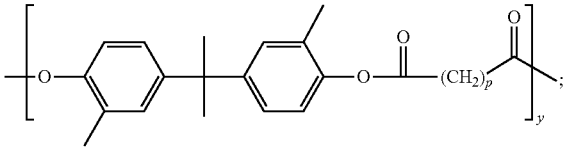
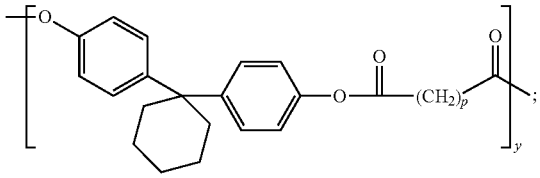
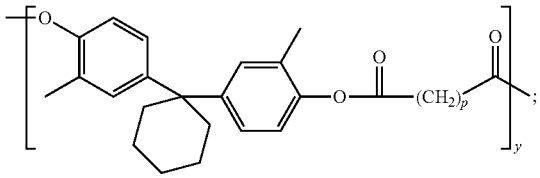
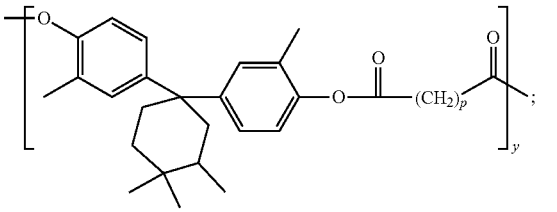
or
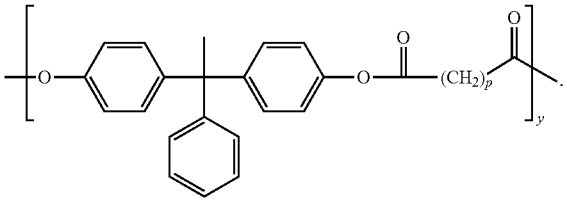
wherein p is from 3 to 8 or from 4 to 6; and y is from about 1 to about 6.
In yet certain of such embodiments, the dicarboxylic acid terminal units have the following structures:
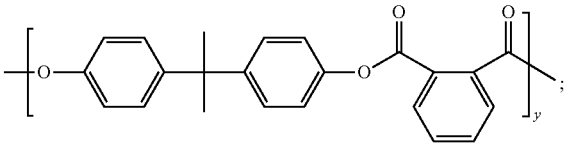
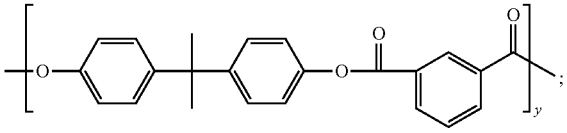
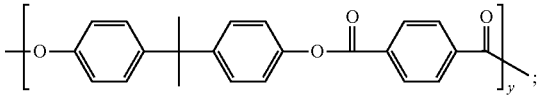
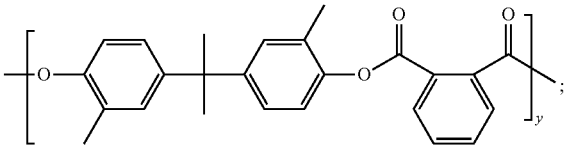
-continued
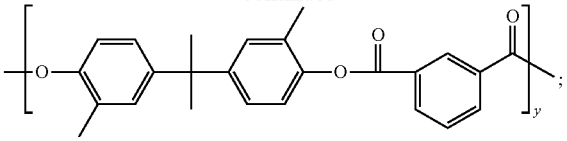
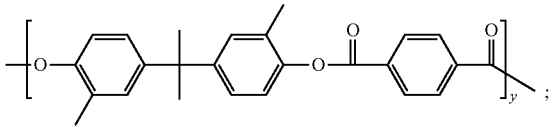
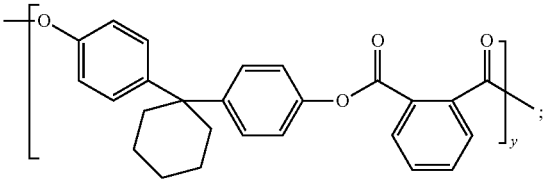
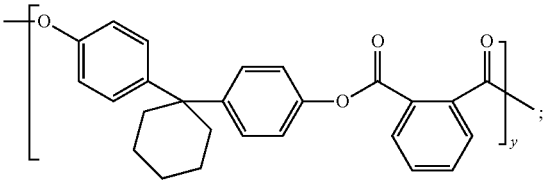
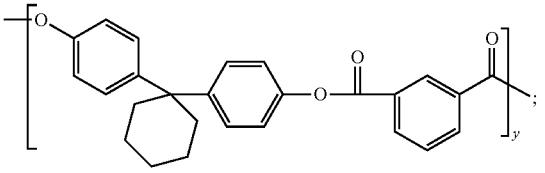
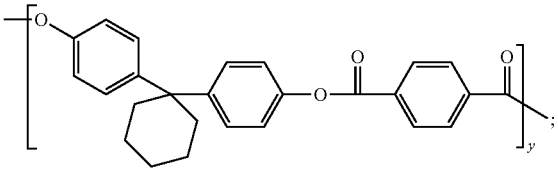
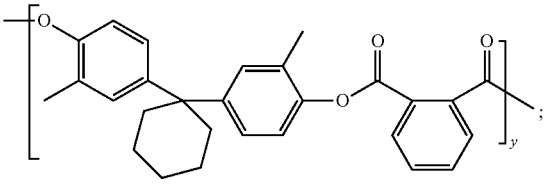
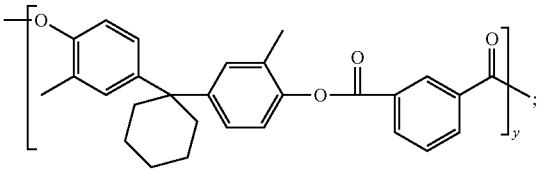
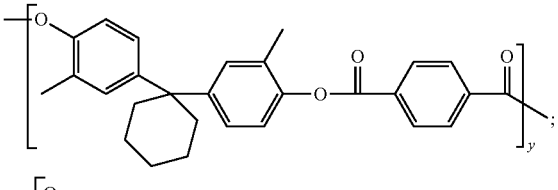
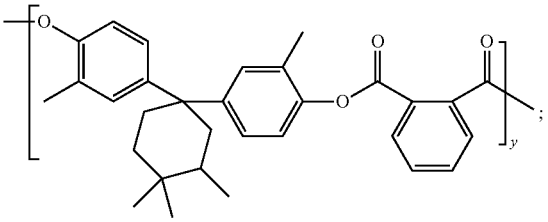

-continued
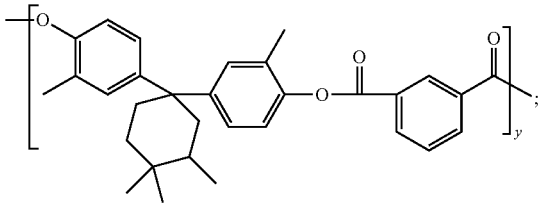
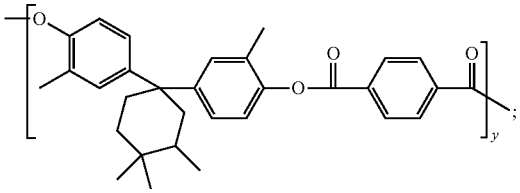
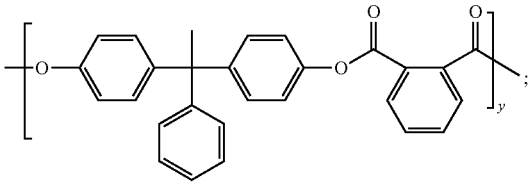
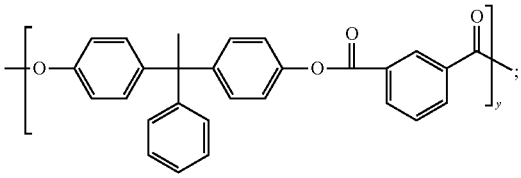
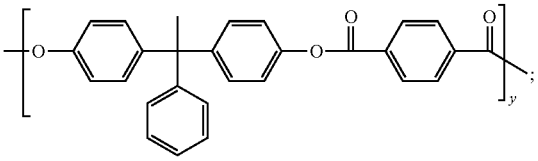
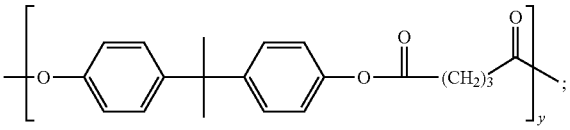
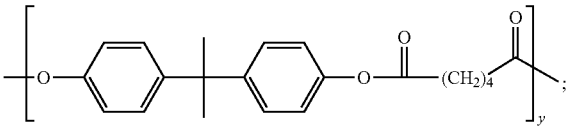
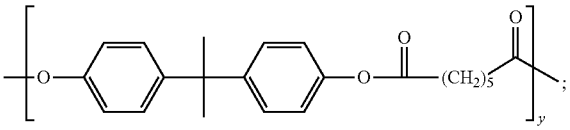
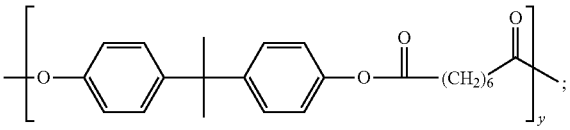
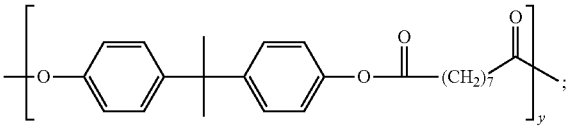
-continued
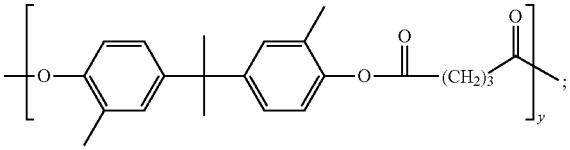
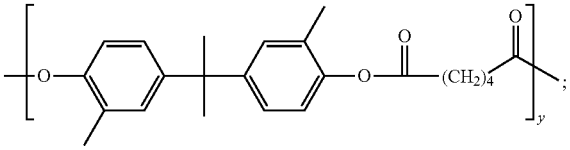
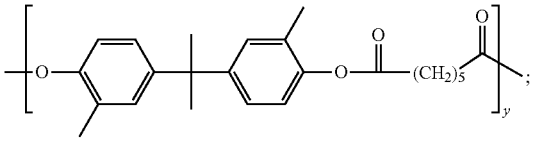
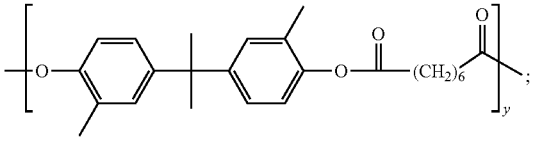
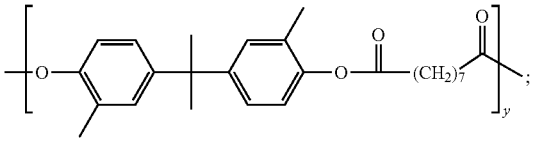
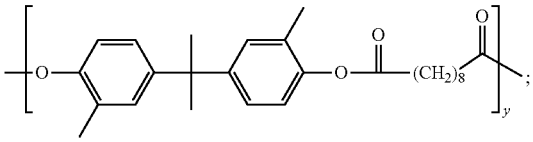
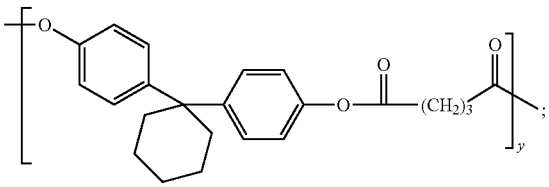
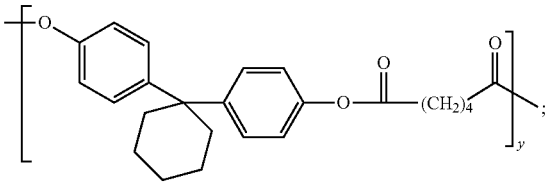
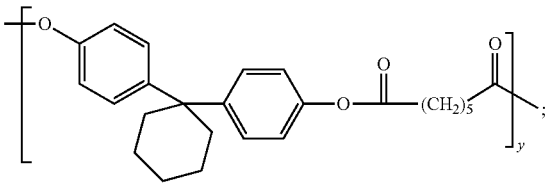
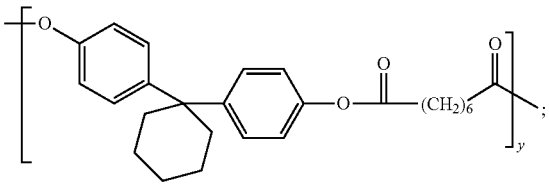

-continued
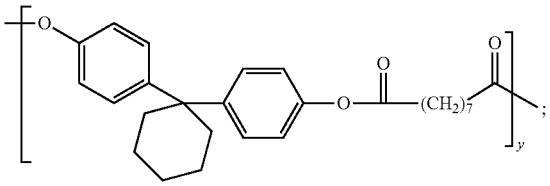
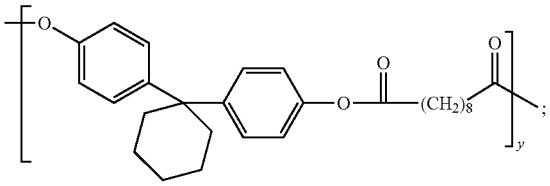
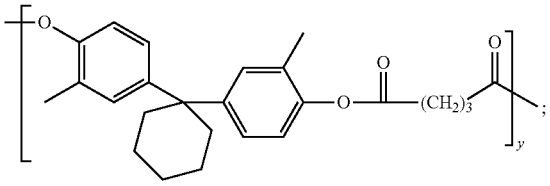
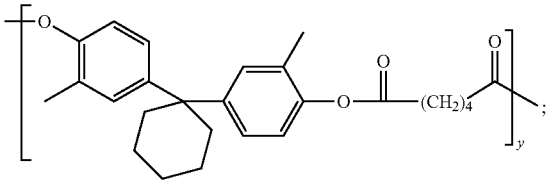
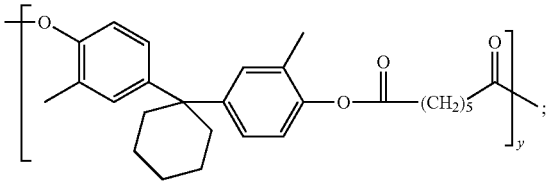
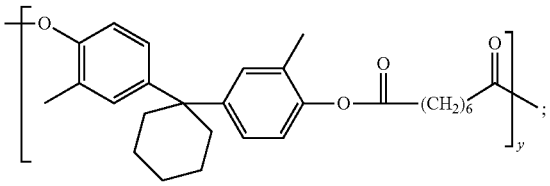
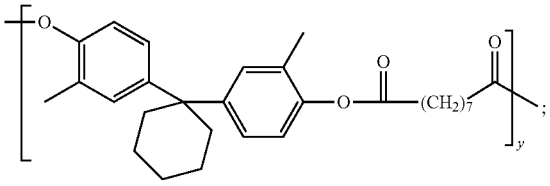
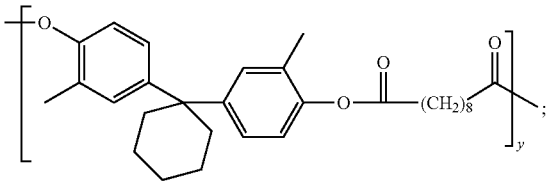
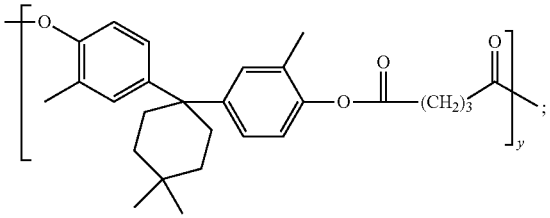
-continued
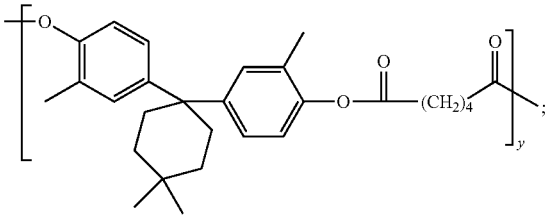
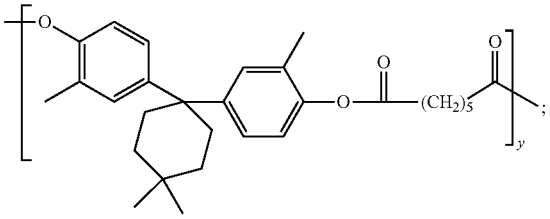
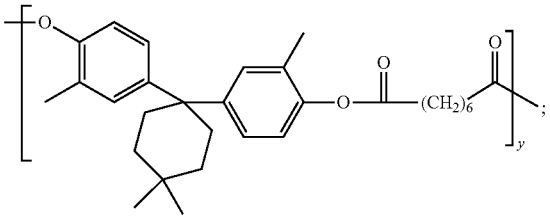
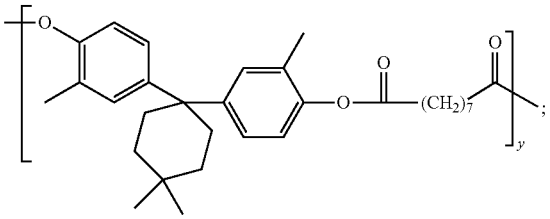
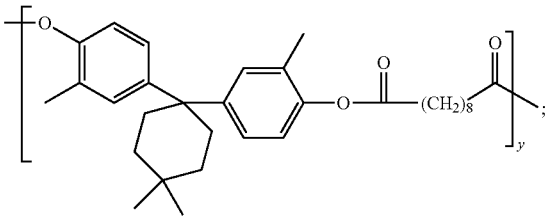
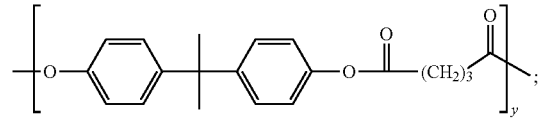
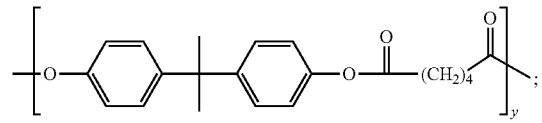
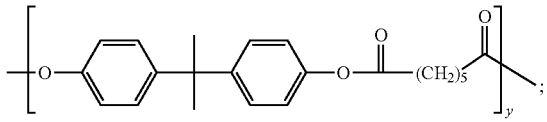
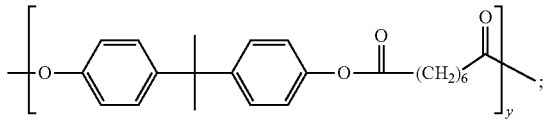
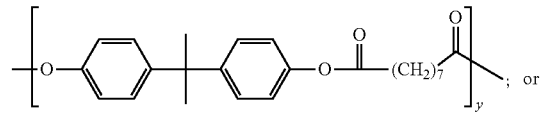
; or -continued

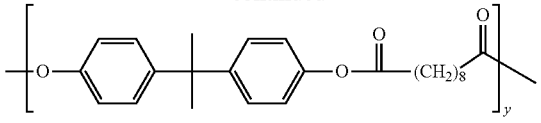

wherein y is 1 to 6.

In specific embodiments, the dicarboxylic acid segment in Block B may be derived from an aromatic dicarboxylic acid such as a phthalic acid, an terephthalic acid, an isophthalic acid, or derived from an aliphatic acid such as an glutaric acid, adipic acid, heptanedioic acid, octanedioic acid, azelaic acid, decanedioic acid, and the like as shown below:

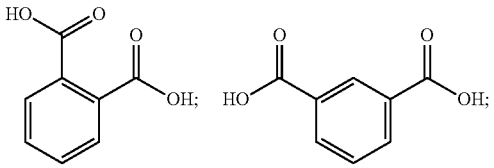

-continued

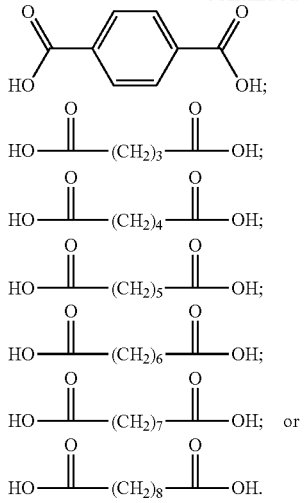

In certain embodiments, the A-B diblock copolymer has a structure of Formula II:

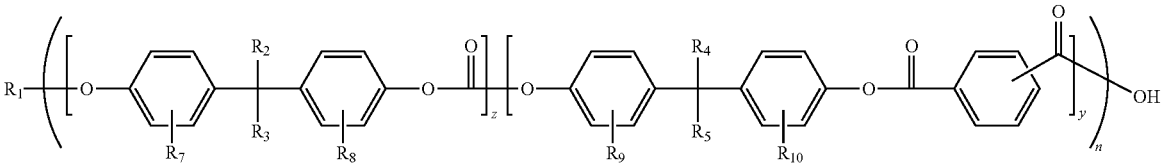

wherein the Block A and Block B are independently selected from the above lists.

In certain embodiments, the A-B diblock copolymer has a structure of Formula III:

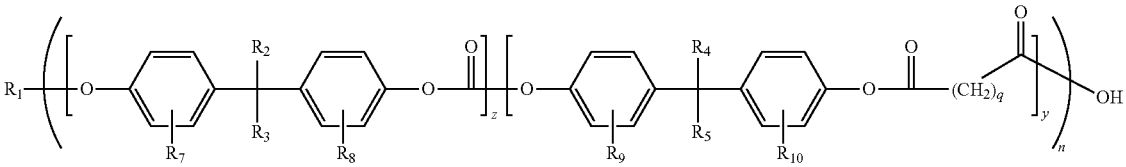

wherein the Block A and Block B are independently selected from the above lists. $R_1$ to $R_5$ and $R_7$ to $R_{10}$ are defined in the present embodiments discussed above.

In a specific embodiment, wherein the A-B diblock copolymer is comprised of a bisphenol A polycarbonate segmental block (A) and a phthalic acid containing segmental block (B) terminal as represented by the molecular structures described in Formula (I) and Formula (II) below:

Formula (I)

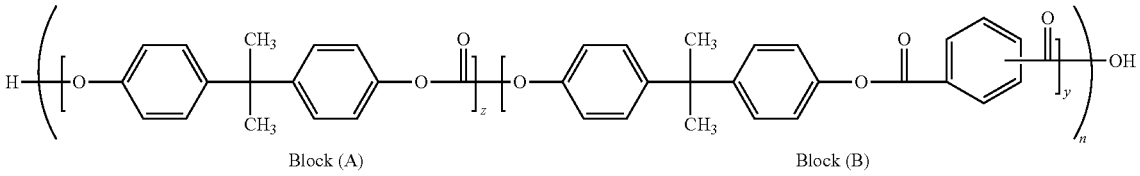

-continued

Formula (II)

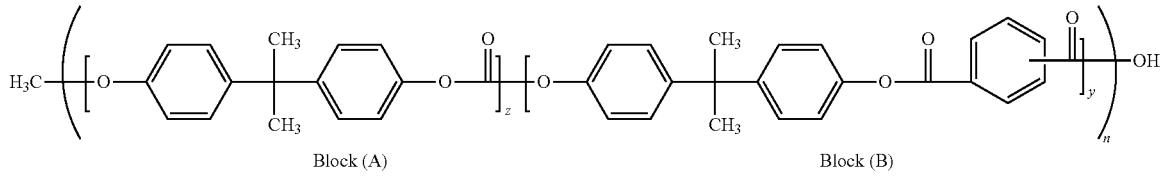

wherein z represents the number of bisphenol A repeating units in segmental block (A) of from about 9 to about 18, y is number of repeating phthalic acid segmental block (B) of from about 1 to about 2, and n is the degree of polymerization between about 20 and about 90 for the copolymer having a weight average molecular weight between about 100,000 and about 250,000 and mixtures thereof.

Plasticized CTL, CGL, and Ground Strip Layer

From an imaging member manufacturing point of view, the addition of an ACBC in the flexible imaging member incurs material cost, adds labor involvement, and also reduces daily imaging member product throughput too, so efforts devoted to the elimination of ACBC 1 of FIG. 1 has been pursued. In the most recent negatively charged flexible electrophotographic imaging member development break through, structurally simplified imaging member designs (with the elimination of ACBC 1 from FIG. 1) have been successfully achieved and demonstrated by CTL plasticizing approach. In these structurally simplified imaging member belts, incorporation of a high boiler liquid plasticizer (say diethyl phthalate) into the CTL of the negatively charge imaging member web helps reduce the dimensional contraction differential between the CTL and the flexible substrate support caused by heating/drying and cooling steps during imaging member preparation process to relieve the internal tension stress/strain build-up in the CTL and minimizes the degree of the imaging member curl-up. Similarly, the ground strip layer is also incorporated with a plasticizer same as that used in the CTL to complement the imaging member curl control effect.

To minimize the dimensional thermal contraction mismatched magnitude between the CTL 20 and the support substrate 10, liquid plasticizer is then incorporated into the CTL 20 to effect $Tg_{CTL}$ lowering for internal strain $\epsilon$ reduction and give successful imaging member curl suppression result in accordance to equation (1). The selection of viable plasticizer(s) for CTL incorporation has to meet the requirements of: (a) high boiler liquids with boiling point exceeding 250° C. to insure its permanent presence, (b) completely miscible/compatible with both the polymer binder and the charge transport component such that its incorporation into the CTL material matrix cause no deleterious photoelectrical function of the resulting imaging member, and (c) be able to maintain the optical clarity of the prepared plasticized CTL for effecting electrophotographic imaging process. The thickness of the plasticized CTL 20P, after drying and cooling steps, is between about 15 and about 40 micrometers, but preferably to be between about 20 and about 35 micrometers for optimum photoelectrical and mechanical function considerations.

Figure 3:
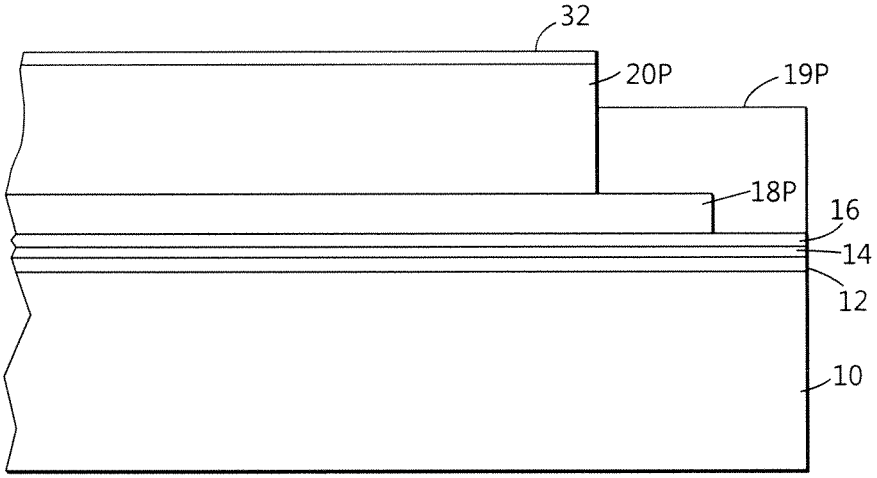
FIG. 3 is a schematic cross-sectional view of a flexible imaging member belt derived from FIG. 1 by plasticizing the charge transport layer and charge generation layer to render the resulting imaging member belt substantially curl-free without an anticurl back coating.

In the same manner, the CGL 18 and the ground strip layer 19 are also likewise plasticized to provide complementary imaging member curl control and give a substantially or nearly flat configuration imaging member as shown in FIG. 3. Thus, the CTL 20P, CGL 18P, and the ground strip layer 19P has plasticizer incorporated into each respective layer to provide total internal stress/strain reduction for effective for curl control, so the resulting imaging member as obtained in FIG. 3 is a simplified structure from that shown in FIG. 1 but without an ACBC 1.

The selected liquid plasticizers are high boilers having a boiling point of at least 250° C. to insure its permanent presence in each reformulated layer. These plasticizers include (1) organic liquid plasticizers such as phthalates and bisphenol liquids, (2) liquid oligomeric styrenes, or derivatives thereof, such as low molecular weight polystyrenes, and (3) fluorocontaining organic liquids which are capable of providing surface energy lowering benefit to render slipperiness of the formulated CTL 20P to effect surface contact frictional reduction for wear resistance enhancement as well as toner image transfer efficiency to receiving paper for copy print out quality improvement.

Organic Liquid Plasticizers

Organic liquid plasticizers having the generic following formula:

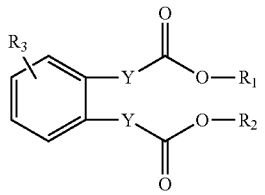

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$; and $R_4$ is $C_1$-$C_6$ alkyl. In certain embodiments, each $R_1$, $R_2$ and $R_4$ is independently methyl, ethyl, propyl or butyl.

Non-limiting exemplary phthalates include the following
Formula (I)
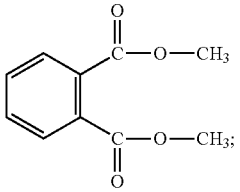
Formula (IA)
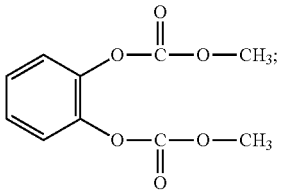
Formula (II)
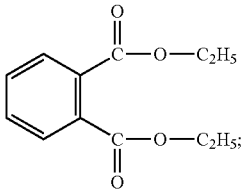
Formula (IIA)
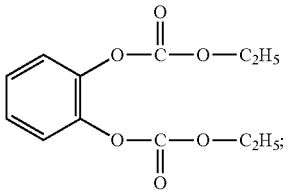
-continued
Formula (III)
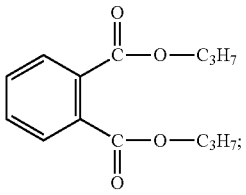
Formula (IV)
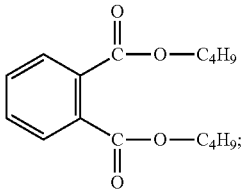
-continued
Formula (V)
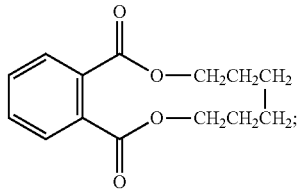
Formula (VI)
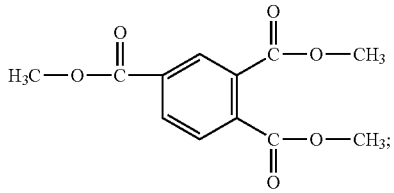
Formula (VII)
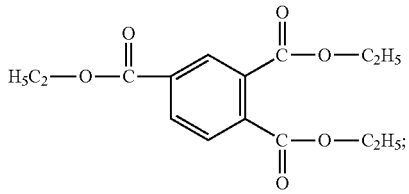
and mixtures thereof.
Non-limiting exemplary monomeric carbonates include the following:
Formula (1)
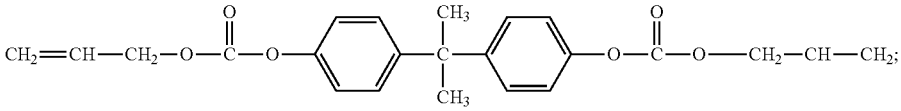
Formulas (2) to (5) may be conveniently derived from Formula (1):
Formula (2)
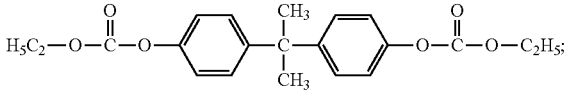
Formula (3)
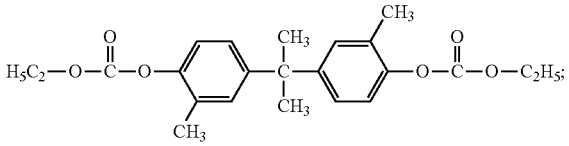

-continued

Formula (4)

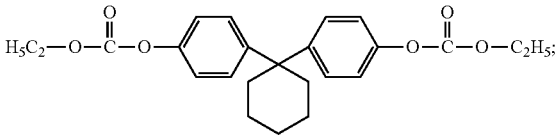

Formula (5)

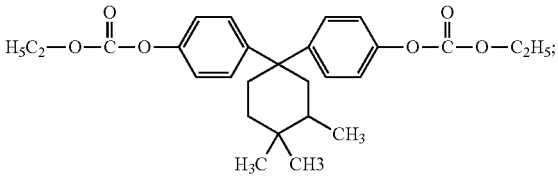

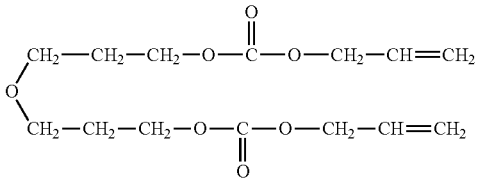

Diethylene glycol bis(allyl carbonate) Formula (6); and mixtures thereof.

Liquid Oligomeric Styrenes

Non-limiting exemplary styrenes include the following:

Formula (B)

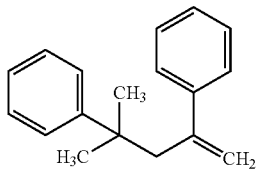

Non-limiting exemplary low molecular weight liquid polystyrenes include the following:

Formula (A)

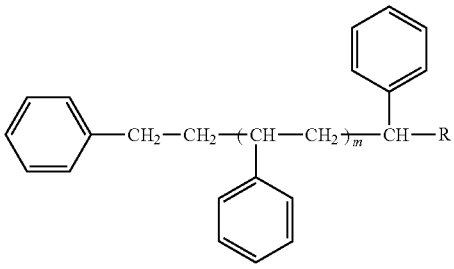

wherein R is selected from the group consisting of H, $CH_3$, $CH_2CH_3$, and $CH{=}CH_2$, and where m is between 0 and 3.

The Alkyl Phthalate Liquid

The alternative plasticizing liquid candidate used for charge transport layer incorporation is a dialkyl phthalate represented by the general molecular Formulas (II) and (IIA) shown below:

Formula (II)

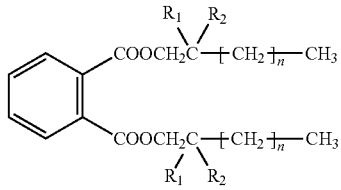

wherein n is an integer from 1 to 5; $R_1$ is same as $R_2$ being H, $CH_3$, and $CH_2CH_3$ or $R_1$ is different from $R_2$.

Formula (IIA)

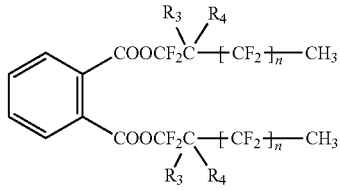

wherein n is an integer from 1 to 5; $R_3$ is same as $R_4$ being F, $CF_3$, and $CF_2CF_3$; or $R_3$ is different from $R_4$. Additionally, the alkyl phthalate may also include the extended structures having the general Formulas (IB) and (IIC) below:

Formula (IIB)

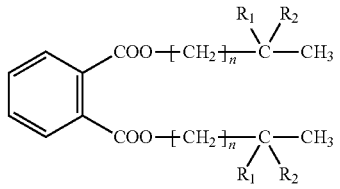

wherein n is an integer from 1 to 5; $R_1$ is same as $R_2$ being H, $CH_3$, and $CH_2CH_3$; or $R_1$ is different from $R_2$.

Formula (IIC)

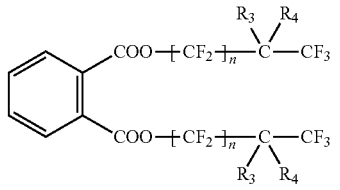

wherein n is an integer from 1 to 5; $R_3$ is same as $R_4$ being F, $CF_3$, and $CF_2CF$ or $R_3$ is different from $R_4$.

In addition, the benefit of utilizing the modified plasticizing liquids to contain fluorinated phthalate structures of those shown in Formulas (IA), (IC), (1A), (1C), (IIA), and (IIC) shown above for charge transport layer incorporation is that they would provide not only the intended plasticizing effect, but could also render the resulting charge transport layer with surface lubricity to ease imaging member belt cleaning as well as toner image transfer to receiving papers during electrophotographic imaging and cleaning processes, Fluoro-Containing Organic Liquids The fluoro-containing organic liquids render plasticizing effect for eliminating the CTL/ground strip layer internal stress/strain build-up for curl control, and provides surface energy reduction effect to impact surface slipperiness enhancement in the resulting CTL/ground strip layer. The same fluoro-containing organic liquids may be used in the ACBC. The fluoro-organic liquids include fluoroketones having the formula:

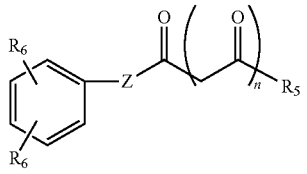

wherein $R_5$ is $C_1$-$C_6$ alkyl, perhaloalkyl, or haloalkyl; Z is null or alkylene; n is 0 or 1; $R_6$ is H, $C_1$-$C_6$ alkoxy, perhaloalkyl, or haloalkyl.

Non-limiting examples fluoroketones are 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, 4,4-difluoro-1-phenyl-1,3-butanedione, and the like. The structures of these fluoroketones are shown below:

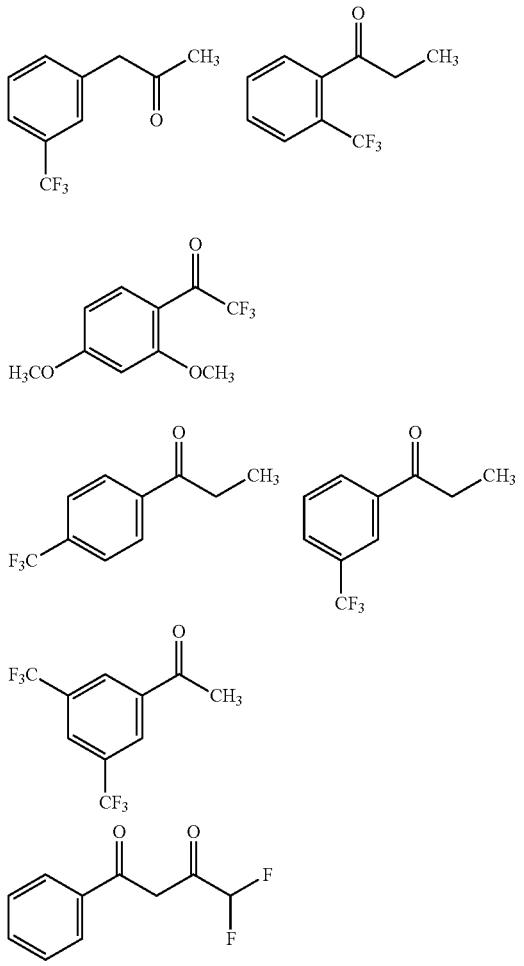

-continued

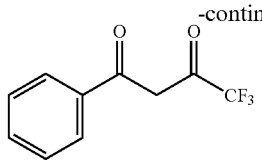

The incorporation of plasticizer into both the CTL, CGL, and the ground strip layer not only is successful to provide the benefits of providing the resulting imaging member belt with excellent curl suppression (eliminating the need for the ACBC), it also produces excellent photoelectrical property stability and prevents early onset of fatigue CTL cracking too to provide imaging member belt service life extension in the field.

Plasticized CTL and plasticized ground strip are described in U.S. patent application Ser. Nos. 12/762,257; 12/782,671; and 12/216,151, the entire disclosures of which are hereby incorporated by reference.

Disclosure Imaging Member II

Figure 4:
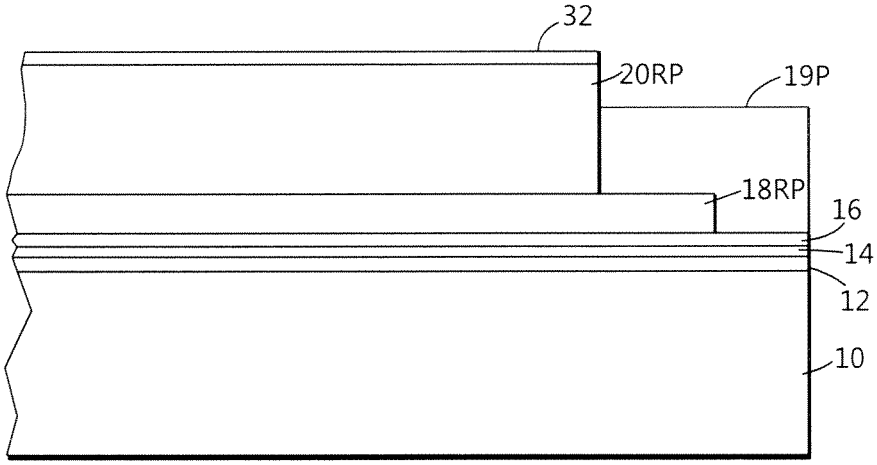
FIG. 4 is a schematic cross-sectional view of a second exemplary flexible imaging member belt modified from that of FIG. 3 to contain a plasticized charge transport layer and charge generation layer both comprising the same A-B diblock copolymer binder to provide curl control for belt flatness without an anticurl back coating according to the present embodiments.

To capture and maintain all the benefits offered by the structurally simplified ACBC-free imaging member design of FIG. 3, but without all the boundary interface associated issues described above, the A-B diblock copolymer of the present embodiments is used as a binder replacement in the plasticized CTL 20RP and plasticized CGL 18 RP reformulations of imaging member illustrated in FIG. 4. A ground strip layer 19P is also shown.

The flexible multilayered electrophotographic imaging member fabricated in accordance with the embodiments of present disclosure, described above, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible imaging belt may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference.

All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments is being indicated by the appended claims rather than the foregoing description. All changes that come within the meaning of and range of equivalency of the claims are intended to be embraced therein. All proportions are by weight unless otherwise indicated.

Control Imaging Member Preparation Example

A structurally simplified anticurl back coating free flexible electrophotographic imaging member web, as shown in FIG. 3 but without the overcoat, was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The tetanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PCZ 200, having a weight average molecular weight of 20,000 and available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1-cyclohexane carbonate) PC-Z 200 plus the inclusion of predetermined amount of diethyl phthalate (DEP) plasticizer were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generation layer coating, comprising of poly(4,4'-diphenyl)-1,1'-cyclohexane carbonate binder, tetrahydrofuran, DEP plasticizer, and hydroxygallium phthalocyanine, was dried at 125° C. for 2 minutes in a forced air oven to form a dry charge generating layer having a thickness of about 0.4 micrometer.

The poly(4,4'-diphenyl)-1,1'-cyclohexane carbonate binder used in the charge generation layer has a molecular formula given in the following molecular formula:

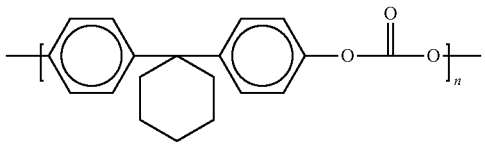

where n is 270

The strip, about 10 millimeters wide, of the adhesive layer left uncoated by the charge generation layer, was coated with a ground strip layer during the co-extrusion of charge transport layer and ground strip coating. The ground strip layer coating mixture was prepared by combining 23.81 grams of bisphenol A polycarbonate resin (FPC 0170, 7.87 percent by total weight solids, available from Mitsubishi Chemicals.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose, plus addition of a pre-determined amount of DEP plasticizer, and 87.7 parts by weight of solvent (Acheson Graphite dispersion RW22790, available from Acheson Colloids Company), and plus a pre-determined amount of DEP plasticizer with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion coating along with a plasticized charge transport layer, to the electrophotographic imaging member web to form an electrically conductive and plasticized ground strip layer.

The charge transport layer was prepared by combining a film forming high molecular weight A-B diblock copolymer binder with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each). The resulting mixture plus addition of a pre-determined amount of DEP plasticizer were then dissolved in methylene chloride to give a 15 percent by weight solid of charge transport layer coating solution and was applied over the plasticized charge generation layer along with the plasticized ground strip layer during the co-extrusion coating process.

The film forming high molecular weight A-B diblock copolymer binder selected for the plasticized charge transport layer formulation was LEXAN HLX commercially available from Sabic Innovative Plastics; it has a weight average molecular weight of about 170,000 and is comprised of a bisphenol A polycarbonate segmental block (A) and a phthalic acid containing segmental block (B) terminal as represented by the molecular structures described in Formula (I) and Formula (II) below:

Formula (I)

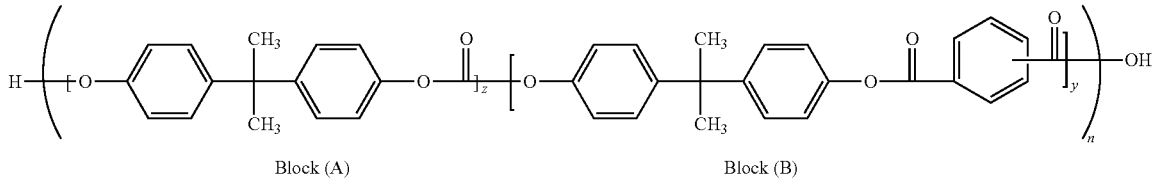

Formula (II)

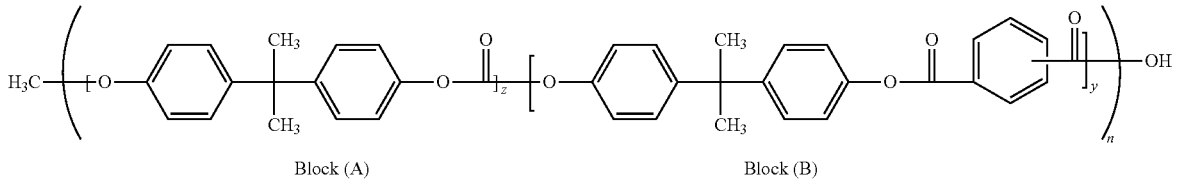

wherein z represents the number of bisphenol A repeating units in segmental block (A) of from about 9 to about 18, y is number of repeating phthalic acid segmental block (B) of from about 1 to about 2, and n is the degree of polymerization between about 20 and about 90 for the copolymer having a weight average molecular weight between about 100,000 and about 250,000 and mixtures thereof.

The diethyl phthalate (DEP) plasticizer selected for incorporation into the charge transport layer/charge generation layer/ground strip layer has a molecular structure formula shown below:

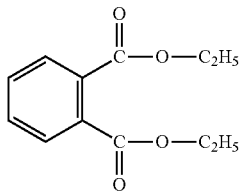

The imaging member web stock containing all of the above layers was then transported at 60 feet per minute web speed and passed through 125° production coater forced air oven to dry the co-extrusion coated ground strip and charge transport layer simultaneously to give respective 19 micrometers and 29 micrometers in dried thicknesses. Since the charge transport layer, charge generating layer, and the ground strip layer were each contained 8.5 percent by weight DEP plasticizer (based on the total weight of the respective layer) to effect internal stress/strain relief in these layers, the resulting imaging member web thus prepared had a simplified structure and was substantially curl-free without the need of an anticurl back coating.

It should be noted that the binder polymer used in the plasticized charge generation layer was poly(4,4'-diphenyl)-1,1'-cyclohexane carbonate which was distinctively different from the A-B diblock LEXAN HLX copolymer binder employed in the formulation of plasticized charge transport layer in this control imaging member. Therefore, boundary interface region of material discontinuity did form between these contiguous layer.

Disclosure Imaging Member Preparation Example

A structurally simplified anticurl back coating free flexible electrophotographic imaging member web, as shown in FIG. 4 but without the overcoat, was then prepared in the very same manner and procedures as described in the above Control Imaging Member Preparation, but with the exception that both the plasticized charge transport layer and the plasticized charge generation layer were reformulated by utilizing the A-B diblock LEXAN HLX copolymer binder in each respective layer. This had thereby provided material continuity between the contiguous charge transport layer and charge generation layer, eliminating the presence of a boundary interfacial region and its associated issues. The reformulated plasticized charge transport layer had a 29 micrometers in thicknesses, whereas the thickness for the charge generation layer was 0.38 micrometer.

The resulting structurally simplified imaging member web prepared according to the present disclosure was substantially curl-free without the application of an anticurl back coating.

Photoelectrical and Mechanical Assessments

Both the disclosure imaging member and the control imaging member were assessed and measure for photo-electrical property by using a laboratory 4000 scanner under a constant current electrical charging test condition. Test results obtained showed that both imaging members had equivalent in charge acceptance ($V_0$) of about 800 volts; sensitivity (S) sensitivity of about 390 volts/ergs/cm$^2$; net residual potential ($V_r$) of about 50 volts; exposure/development voltage ($V_e$) of about 50 and about 60 volts for latent image formation; and low photo-induce discharge (PIDC) potential cycle-up.

Figure 5:
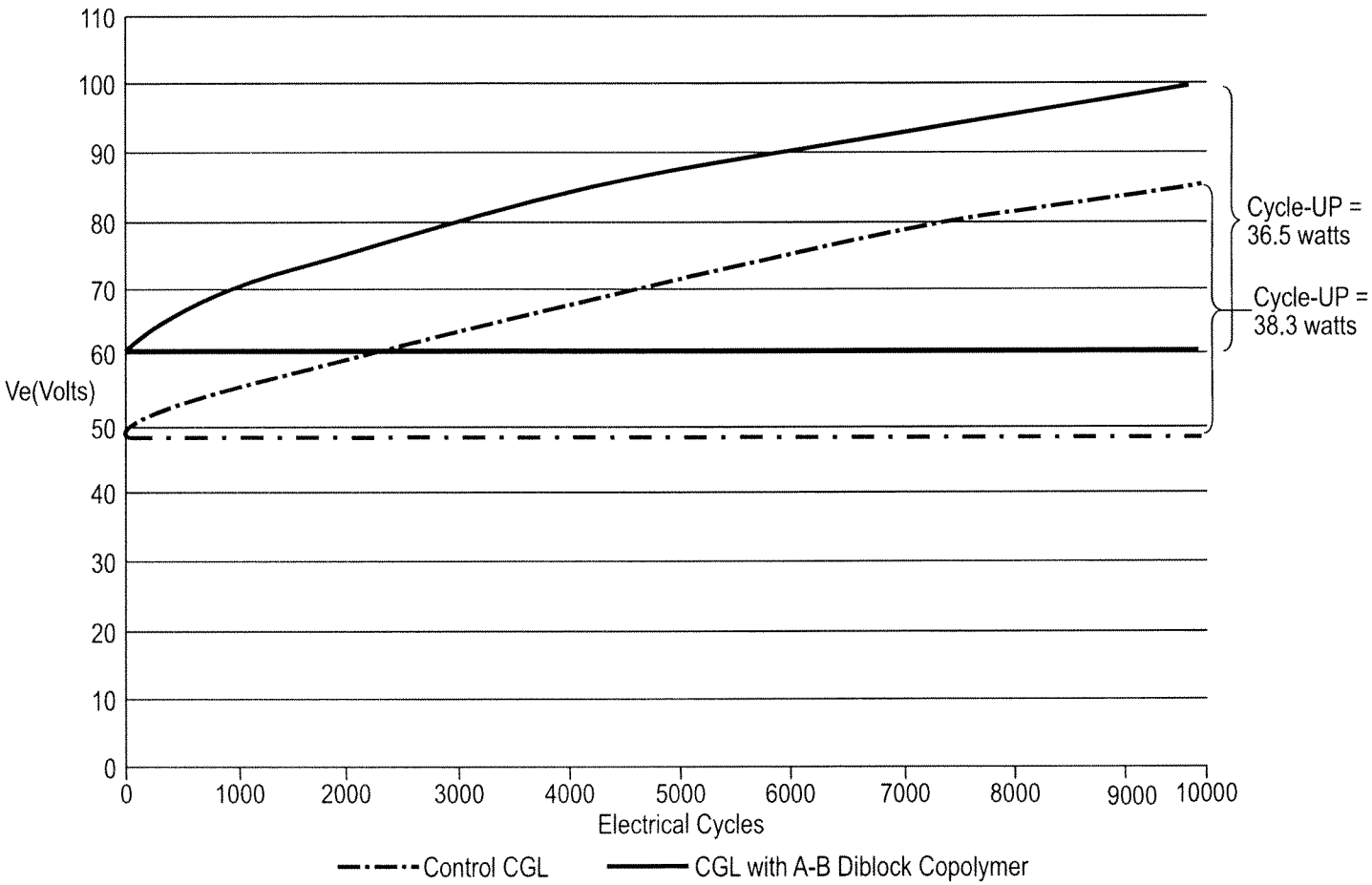
FIG. 5 is chart showing $V_e$ values obtained from zero and up to 10K cycle-up for an imaging member prepared according to the present embodiments compared to the control imaging member counterpart.

However, it is interesting to see that the $V_e$ value of 36.5 volts obtained at 10K cycle-up for the imaging member of this disclosure, as shown in FIG. 5, was slightly lower compared to the 38.3 volts cycle-up seen for the control imaging member. This result is, therefore, a positive indication that the disclosed imaging member (prepared by utilizing LEXAN HLX binder in both charge transport layer and charge generation layer to eliminate the undesirable binder material discontinuity boundary interface region) was more photoelectrical stable than that of the control imaging member counterpart. Although the initial time zero Ve value observed for the disclosed imaging member was 12 volts higher than that of the control imaging member counterpart, this was due to the result of charge generation layer thickness effect; because its charge generation layer, at 0.38 micrometer, was slightly thinner than the 0.4 micrometer charge generation layer thickness in the control imaging member.

Both imaging member webs of the above were further converted to imaging member belts and then machine cyclic print tested. After extensive print testing, the control imaging member belt was seen to develop nano black spot defects in copy printout after 800,000 copy print volume. High magnification TEM cross-section examination of the belt had found that sites of localized nano adhesion failure (delamination/separation) formed at the charge transport layer and charge generation layer interface were the cause for defects seen in the copy printouts. In sharp contrast, the imaging member belt (prepared to use the same LEXAN HLX binder in both plasticized charge transport layer and plasticized charge generation layer) had effectively eliminated the boundary interfacial adhesion failure/delamination problem and its related copy print defects.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A flexible imaging member comprising:

a flexible substrate;

a charge generation layer disposed on the substrate; and at least one charge transport layer disposed on the charge generating layer, wherein the charge generation layer and the charge transport layer comprise a polycarbonate binder being an A-B di-block copolymer having a formula selected from the group consisting of Formula A

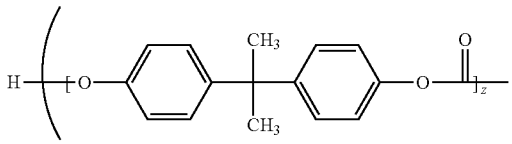

Block (A)

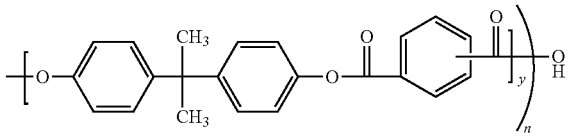

Block (B)

Formula B

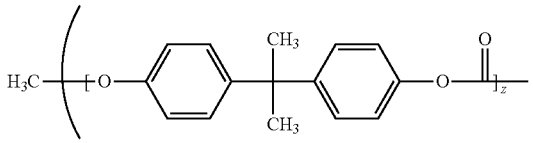

Block (A)

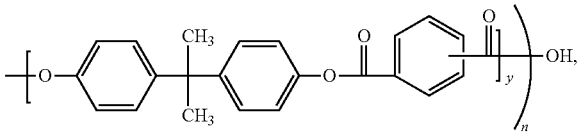

Block (B)

and mixtures thereof, wherein z represents the number of bisphenol A repeating units of block (A) and is from about 9 to about 18, y is number of repeating phthalic acid in block (B) and is from about 1 to about 2, and n is the degree of polymerization and is from about 20 to about 90; wherein the A-B di-block copolymer has a weight average molecular weight of between about 80,000 and about 250,000.

2. The flexible imaging member of claim 1, further including an anticurl back coating positioned on a second side of the substrate opposite to the charge generating layer and the charge transport layer to provide imaging member flatness.

3. The flexible imaging member of claim 2, wherein the charge transport layer has a thickness of from about 15 to about 40 micrometers.

4. The flexible imaging member of claim 1, wherein the charge transport layer and charge generation layer further comprise a plasticizer compound.

5. The flexible imaging member of claim 4 being curl-free without use of an anticurl back coating layer.

6. The flexible imaging member of claim 4, wherein the charge transport layer has a thickness of from about 15 to about 40 micrometers.

7. The flexible imaging member of claim 4, wherein the plasticizer compound in the charge generation layer and the charge transport layer is selected from the group consisting of liquid phthalates, liquid monomeric carbonates, oligomeric polystyrenes, fluoroketones and mixtures thereof.

8. The flexible imaging member of claim 7, wherein the liquid phthalates are selected from the group consisting of Formula (I)

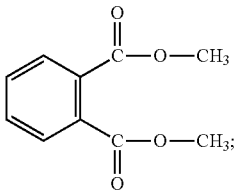

Formula (IA)

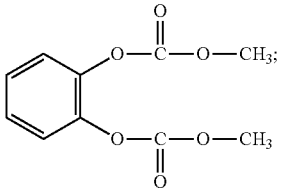

Formula (II)

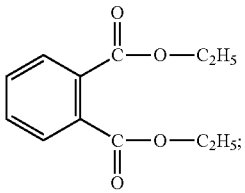

Formula (IIA)

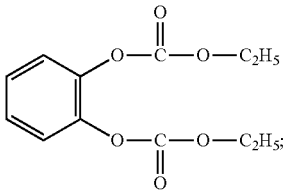

-continued

Formula (III)

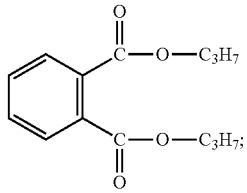

Formula (IV)

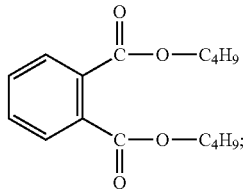

Formula (V)

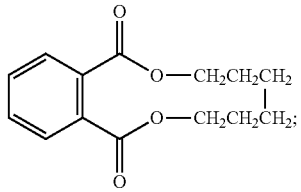

Formula (VI)

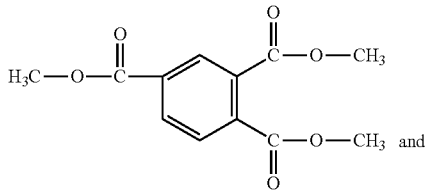

Formula (VII)

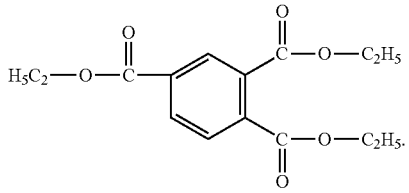

9. The flexible imaging member of claim 7, wherein the liquid monomeric carbonates are selected from the group consisting of Formula (1)
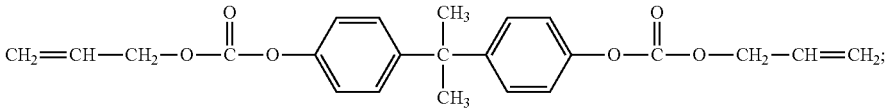
Formula (2)
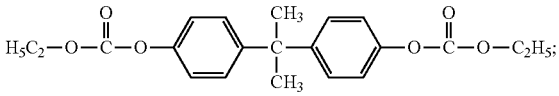
Formula (3)
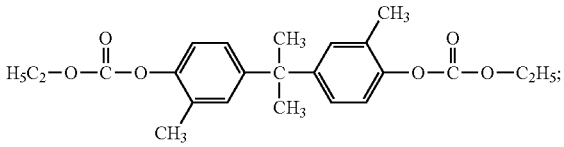
Formula (4)
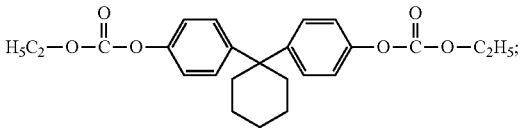
Formula (5)
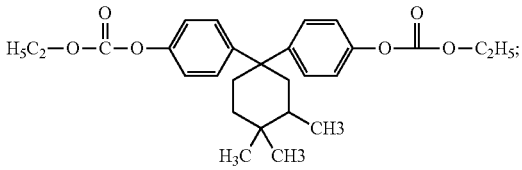
and
Formula (6)
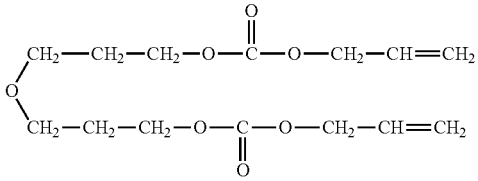
10. The flexible imaging member of claim 7, wherein the oligomeric polystyrenes are selected from the group consisting of
Formula (C)
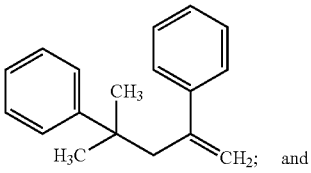
and
-continued
Formula (D)
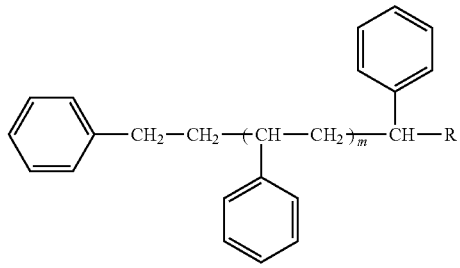

wherein R is selected from the group consisting of H, $CH_3$, $CH_2CH_3$, and $CH{=}CH_2$, and where m is between 0 and 3.

11. The flexible imaging member of claim 7, wherein the fluoroketones are selected from the group consisting of 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, and 4,4-difluoro-1-phenyl-1,3-butanedione.

12. The flexible imaging member of claim 1, wherein exposure voltage ($V_e$) of the flexible imaging member is from about 50 to about 60 volts for latent image formation.

13. The flexible imaging member of claim 1, wherein no delamination or separation between the charge generation layer and the charge transport layer is observed via transmission electron microscopy (TEM).

14. A flexible imaging member comprising:

a flexible substrate;

a charge generation layer disposed on the substrate; and at least one charge transport layer disposed on the charge generating layer, wherein the charge generation layer and the charge transport layer comprise a polycarbonate binder being an A-B di-block copolymer having a formula selected from the group consisting of Formula A

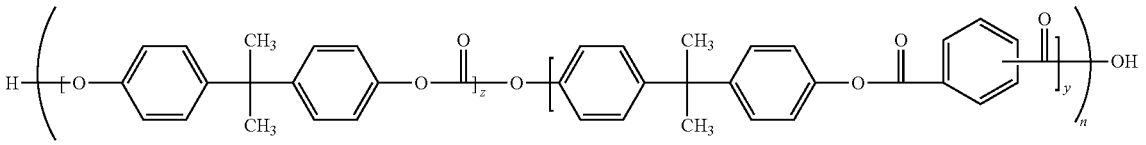

Block (A) Block (B)

Formula B

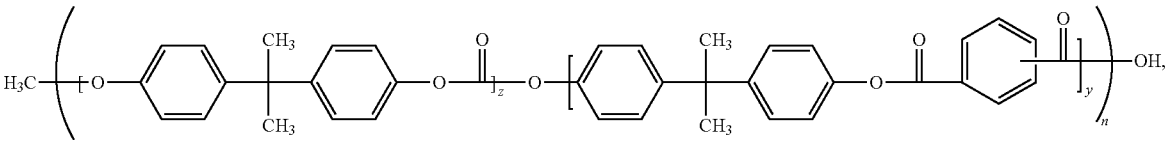

Block (A) Block (B)

and mixtures thereof, and comprises about 90% mole bisphenol A polycarbonate segment block (A) and about 10% mole phthalic acid containing segment block (B) in linear linkage of the copolymer chain backbone, wherein z represents the number of bisphenol A repeating units of block (A) and is from about 9 to about 18, y is number of repeating phthalic acid in block (B) and is from about 1 to about 2, and n is the degree of polymerization and is from about 20 to about 80; wherein the A-B di-block copolymer has a weight average molecular weight of between about 80,000 and about 250,000.

15. An image forming apparatus for forming images comprising:

a) a flexible imaging member having a charge retentive-surface for receiving an electrostatic latent image thereon, wherein the flexible imaging member comprises a flexible substrate;

a charge generation layer disposed on the substrate; and at least one charge transport layer disposed on the charge generating layer, wherein the charge generation layer and the charge transport layer comprise a polycarbonate binder being an A-B di-block copolymer has a formula selected from the group consisting of Formula A

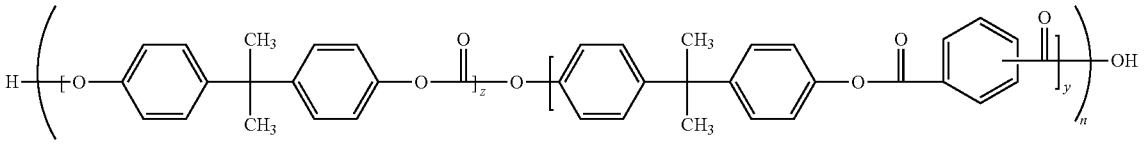

Block (A) Block (B)

Formula B

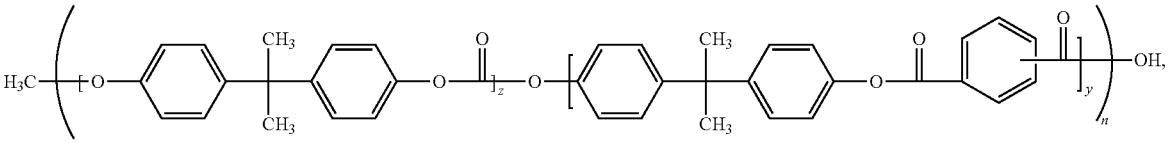

Block (A) Block (B)

and mixtures thereof, wherein z represents the number of bisphenol A repeating units of block (A) and is from about 9 to about 18, y is number of repeating phthalic acid in block (B) and is from about 1 to about 2, and n is the degree of polymerization and is from about 20 to about 90, wherein the A-B di-block copolymer has a weight average molecular weight of between about 80,000 and about 250,000;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *